US006418644B1

(12) United States Patent
Bykov et al.

(10) Patent No.: US 6,418,644 B1
(45) Date of Patent: Jul. 16, 2002

(54) APPARATUS AND METHOD FOR PADDING THE GROUND BELOW A DUCT USING EXCAVATED SOILS, EQUIPMENT FOR COMPACTING SOIL BELOW A DUCT, AND A SOIL-COMPACTING MECHANISM

(75) Inventors: Alexandr V. Bykov, Kiev; Stanislav K. Vasilenko, Kremenchug; Andrei B. Koval, Kiev, all of (UA); Alexandr S. Kumylganov, Moscow (RU); Jury B. Leichenko, Kiev (UA); Jury M. Mamontov, Moscow (RU); Aly A. Movchan, Kremenchug (UA); Vladimir D. Musiiko; Alexey N. Schipkovsky, both of Kiev (UA); Valery D. Chernaev, Moscow (RU); Viktor I. Yakovlev, Krementschug (UA)

(73) Assignees: Obschetvo s Ogranichennoi Otvetstvennostju nauchho-issledovateelsky i Tekhnichesky Tsentr"ROTOR", Kiev (FR); Aktsionerno Obschesryo Otktytogo Tina Aktsionernaya Kompania po transdortuNrettiMoscow, Moscow (RU)

( * ) Notice: Subject to any disclaimer, the term of this patent is extended or adjusted under 35 U.S.C. 154(b) by 0 days.

(21) Appl. No.: 09/446,603

(22) PCT Filed: Jun. 26, 1998

(86) PCT No.: PCT/UA98/00011

§ 371 (c)(1),
(2), (4) Date: Feb. 25, 2000

(87) PCT Pub. No.: WO99/00556

PCT Pub. Date: Jan. 7, 1999

(30) Foreign Application Priority Data

Jun. 27, 1997 (UA) ..... 97063284

(51) Int. Cl.[7] ..... E02F 5/10; E02D 3/046

(52) U.S. Cl. ..... 37/142.5; 405/179

(58) Field of Search ..... 37/142.5; 405/179, 405/271; 404/133.05, 133.2

(56) References Cited

U.S. PATENT DOCUMENTS 3,701,422 A * 10/1972 Downey (List continued on next page.)

FOREIGN PATENT DOCUMENTS

RU 127282 10/1960

(List continued on next page.)

*Primary Examiner*—Christopher J. Novosad
(74) *Attorney, Agent, or Firm*—Burns, Doane, Swecker & Mathis, l.L.P.

(57) ABSTRACT

The present invention relates to a method for padding ground below a duct (1) using excavated soil (2), wherein said method uses a vehicle (6) that comprises a soil feeding organ (13), a transport organ (14) and soil compacting organs (104, 105). The vehicle moves along a ground path (16) which is formed by the soil feeding organ (13) as it collects excavated soil (2). This method allows for a reliable orientation of the soil compacting organs (104, 105) relative to the duct (1), wherein said compacting organs apply a force on the soil previously deposited in the trench (4). This invention also relates to a device which is used for padding ground below a duct (1) and comprises a device (106) for hanging a soil-compacting mechanism (103) to the vehicle (6). The device (106) includes a disconnection mechanism (153) that enables the cyclic displacement of the rammer-type compacting organs (104, 105) in the displacement direction of the vehicle (6). When compacting soil, the working members (171) of the compacting organs (104, 105) are capable of cyclic downward displacement towards each other while simultaneously rotating in a direction in which the angle they define becomes smaller. This system may be used for efficiency compacting soil below a duct (1) while minimising the stress applied by the soil to the surface of said duct (1).

48 Claims, 10 Drawing Sheets

U.S. PATENT DOCUMENTS 3,807,067 A * 4/1974 Cloud
3,908,292 A * 9/1975 Harris
4,633,602 A 1/1987 Layh et al.
4,735,523 A * 4/1988 Ishikawa et al.
4,912,862 A * 4/1990 Bishop et al.
4,981,396 A * 1/1991 Albertson et al.
5,097,610 A * 3/1992 Bishop
5,120,433 A * 6/1992 Osadchuk
5,911,544 A * 6/1999 Mahoney

FOREIGN PATENT DOCUMENTS

| | | |
|---|---|---|
| RU | 2044119 | 5/1989 |
| SU | 791822 | 12/1980 |
| SU | 855137 | 8/1981 |
| SU | 1036828 | 8/1983 |
| SU | 1142601 | 2/1985 |

* cited by examiner

C-C

B-B

APPARATUS AND METHOD FOR PADDING THE GROUND BELOW A DUCT USING EXCAVATED SOILS, EQUIPMENT FOR COMPACTING SOIL BELOW A DUCT, AND A SOIL-COMPACTING MECHANISM

TECHNICAL FIELD

The invention relates to the field of technology and hardware for earthmoving operations predominantly in replacement of the insulation coating of ducts, performed at the design elevations of ducts in the trench, predominantly without interrupting the operation of the insulation coating replacement, and more particularly to the methods and devices for padding the ground below a duct using excavated soil, equipment for soil compacting below a duct and soil compacting mechanisms. Furthermore, the invention can find an application in earth-moving operations in construction of new underground ducts.

BACKGROUND OF THE INVENTION

The advantages of such a technology of replacement of the insulation coating on operating ducts in the trench became obvious long ago to the experts who began making certain efforts for its introduction into practice. Known is the technology of replacement of the insulation coating, in which the duct is held above the trench bottom by stationary supports [S. A. Teylor. "Mechanising the operations on replacement of the insulation coating of operating ducts in the trench" // Neft', gaz i neftekhimia za rubezohm, 1992, #10, p. 75–83]. In this case padding the ground below a duct is performed by regular earth-moving and construction machinery, due to the use of the above supports. However, the regular construction machinery does not provide a satisfactory solution for the problem of padding the ground below a duct using excavated soil, even when the above supports are applied. It is preferable to replace the insulation coating of the duct during continuous displacement of the entire system of the appropriate equipment without making use of the above supports. This requires more from the technology and equipment for padding the ground below a duct using excavated soil (feeding excavated soil from the dump, its deposition into the trench and compacting below the duct), which requirements cannot be met by the used in practice technology for performing the above-mentioned operations or the construction machinery, or by the other technologies and appropriate hardware which are not used in practice but are known from the state-of-the-art. In this case, the technology of padding the ground below a duct using excavated soil should envisage, and the appropriate device should be capable of, performing its function during its continuous uninterrupted displacement at a velocity which is equal to the velocity of displacement of the entire system (preferably 150 to 100 m/h), and the device should apply a minimal force on the insulation coating, which excludes damage to the coating even at its low strength, as when padding the ground below a duct after a small interval of time (3 to 7 min.) after application of the insulation coating, this time not being enough for some kinds of the coating to acquire its full strength. Furthermore, the device for padding the ground below a duct using excavated soil should have minimal overall dimensions in the direction along the duct for reduction of the length of the unsupported section of the duct to such an extent, as to eliminate or minimize the use of mobile means of supporting a duct. The device should provide a rather high degree of padding the ground below a duct (characterised by a bed coefficient $K_y$ equal to 0.5 to 1 $MN/m^3$) in order to avoid the significant subsequent slumping of the duct and appropriate deformation loads in it. Furthermore, the device for padding the ground below a duct using excavated soil should operate in a reliable manner when displaced over the surface of soil with significant unevenness and a lateral gradient, as well as over soil with low load-carrying capacity, for instance marshland or a layer of loose excavated soil. It is exactly the absence at the present time of such a technology and means for padding the ground below a duct using excavated soil which largely prevents a broad use in practice of the technology of replacement of the insulation coating on the operating ducts in the trench without the use of supports for the duct resting against the trench bottom. Thus, the inventors were faced with a complicated and important problem unsolved in a manner required for practical application, despite the numerous attempts at solving it for many years.

Known is a method of padding the ground below a duct which includes picking-up soil, its deposition into the trench from both sides of the duct and soil compacting in the space below the duct by rammer-type soil compacting organs applying a force on the soil previously deposited in the trench, during continuous displacement over the soil surface along the duct of a vehicle carrying soil feeding and soil compacting organs. Unlike the claimed method, in the known method the travelling unit with a wider base of the vehicle, moves along both edges of the trench, over the soil surface formed during uncovering of the duct, and the soil is picked up from the trench edges (Vasilenko S. K., Bykov A. V., Musiiko V. D. "Technology and system of technical means for overhauling the line oil pipelines without lifting the pipe" // Truboprovodni transport nefti, 1994, #2, p. 25–27]. The vehicle displacement along both edges of the trench complicates the process of placement on and removal from the uncovered duct, possibly causing emergency situations if the vehicle falls off the trench edge and non-uniform slumping of the travelling unit of the vehicle. Furthermore, soil picking-up from the trench edges unreasonably increases the scope of earth-moving operations.

The closest known method to the claimed method is the method of padding the ground below a duct using excavated soil, which include soil picking-up from the dump, soil transportation in the direction from the dump towards the trench with the duct, soil deposition into the trench from both sides of the duct and filling at least part of the trench space with soil, during continuous displacement over the surface of the soil along the duct of a vehicle carrying the soil feeding and transport organs, and compacting the soil at least in the space below a duct by soil compacting organs applying a force on the soil during continuous displacement over the soil surface along the duct, of a vehicle carrying soil compacting organs. Unlike the claimed method, in the known method the vehicle carrying the soil feeding, transport and soil compacting organs, is displaced over the soil surface from the trench side opposite to the dump, whereas the force is applied to the soil by soil compacting organs made in the form of throwers, prior to its deposition into the trench, which accelerate the soil up to the velocity sufficient for dynamic self-compacting of the soil during its deposition into the trench [USSR Author's Certificate 855137, IPC E02F 5/12, 1981]. Displacement of the vehicle over unprepared soil surface results in the vehicle, and the soil compacting organs together with it, rocking when passing over uneven ground, with soil particles (in particular, large-sized rocky inclusions) hitting the surface of the duct insulation coating at a high speed, and breaking it. Furthermore, even with a stable position of the vehicle, it is impossible to direct the high-speed flow of soil below a duct with such a precision as to, on the one hand, eliminate formation of a cavity under the duct, and on the other hand, prevent collision of the high speed soil particles with the insulation coating surface. This method does not permit achievement of the required degree of compacting of soil below a duct, which would provide small enough slumping of the duct, and, therefore, its small deformation loading, this being especially important in performance of this work without interruption of the duct operation. This method is difficult to implement when excavated fertile soil is located on the trench side opposite to that of the mineral soil dump location. For its implementation, this method requires an appropriate device with a long extension of soil feeding organ, this being difficult to implement in technical terms. Moreover, this process of padding ground below a duct involves higher power consumption.

The closest to the claimed device, is a device known from prior art for padding ground below a duct using excavated soil, which comprises a vehicle with the travelling unit for displacement over the soil surface, carrying the equipment for filling the trench with excavated soil, which includes the soil feeding and transport organs and a device for lifting-lowering of the soil feeding organ relative to the vehicle, and equipment for soil compacting below a duct, including a soil compacting mechanism with drive soil compacting organs and a device for hanging the soil compacting mechanism from the vehicle with the capability of forced displacement and securing relative to the vehicle in a plane which is normal to the direction of its displacement. Unlike the claimed device, in the known device the soil feeding organ is located to the side of the vehicle with a large extension relative to it, for allowing its displacement on the trench side opposite to the dump. The soil feeding and transport organs are designed as one working organ of the screw conveyor hung from the vehicle with a device for hanging the soil compacting mechanism, and the soil compacting organs are made in the form of driven soil throwers whose inlets are connected to the soil outlets of the equipment for filling the trench. Here, the soil compacting mechanism includes the drive mechanism of rocking of the soil compacting organs [USSR Author's Certificate # 855137, IPC E02F 5/12, 1981]. The known device has all the disadvantages indicated above for the appropriate method. Furthermore, the known device is not stable enough in the transverse plane, has higher power consumption for picking-up the soil, its feeding and deposition into the trench, the screw-conveyor type working organ and the throwers are poorly adapted to operation in boggy sticky soils as a result of the soil sticking to them.

The closest known equipment to the claimed equipment is the equipment for soil compacting below a duct, incorporating a soil compacting mechanism and a device for hanging the soil compacting mechanism to a vehicle, including an integrated mechanism for forced displacement and rigid fastening of the soil compacting mechanism relative to the vehicle in the plane normal to the vehicle displacement direction [USSR Author's Certificate 855137, IPC E02F 5/12, 1981]. Because the known device for hanging the rammer-type soil compacting mechanism lacks a disconnection mechanism for a cyclic displacement of soil compacting organs relative to the vehicle in the direction of its movement, it will be impossible to perform continuous displacement of the vehicle during the soil compacting. This is an especially significant disadvantage for a device which is designed for use as part of a complex of earth-moving machinery in replacement of the insulation coating of a duct, performed on design elevations of the duct in the trench, predominantly without the use of supports for holding it, when a continuous and coordinated displacement of all the machinery of the complex along the entire duct is required.

The closest known mechanism to the claimed mechanism is a soil compacting mechanism known from prior art, incorporating a base which carries the drive soil compacting organs each of which includes a connecting rod with a soil compacting element at its lower end, lower lever which is connected to the connecting rod by its first hinge, and to the base by the second one, and upper lever which is connected to the upper end of the connecting rod by third hinge. Unlike the claimed mechanism, in the known mechanism, the upper lever is connected to the lever vibration mechanism, whereas the working surfaces of soil compacting elements are located in the radial direction relative to third hinges [USSR Author's Certificate #1036828, IPC E01C 19/34, E02D 3/46, 1983]. In the known mechanism, the soil compacting elements travel practically in the horizontal transverse direction with connecting rods rotation about the axes of third hinges. In this case, it is impossible to withdraw soil compacting elements from the soil for their displacement along the duct with a stable position of soil compacting mechanism relative to the duct, it is impossible to form below a duct a zone of soil compacting with slopes or provide uniform compacting of soil along the entire height of the space below a duct, especially with rather great above-mentioned height. for instance, of about 0.8 m. Operation of this mechanism is difficult or practically impossible in relatively narrow trenches. Another disadvantage of the known mechanism is its great height. complicating movement into the trench, withdrawing from the trench, and displacement of the vehicle with the soil compacting mechanism hung to it.

SUMMARY OF THE INVENTION

The main goal of the invention is to provide a method for padding the ground below a duct using excavated soil to minimize the stress applied by the soil to the surface of the insulation coating of a duct during its deposition while compacting the soil below a duct with a greater degree of soil compaction, and to eliminate damage to the insulation coating or duct by the soil compacting organs by providing a steady vehicle position through preparation of soil surface prior to vehicle displacement, and to reduce the power consumption of the deposition and soil compaction processes.

The above goal is achieved by the method for padding ground below a duct using excavated soil, including soil picking-up from the dump, soil transportation in the direction from the dump towards the trench with the duct, soil deposition into the trench from both sides of a duct to fill at least the space below a duct, and soil compacting, at least the space below a duct by applying stress to the soil by soil compacting organs during continuous displacement over the soil surface along the duct of one or two vehicles carrying the soil feeding, transport and soil compacting organs. The vehicle carrying at least the soil compacting organ can be displaced over the ground surface along a ground path formed by the soil feeding organ during soil feeding from the dump while stress is applied by soil compacting organs to the soil which has already been deposited into the trench.

Unlike the process of dynamic self-compacting of soil in its feeding under a duct at a high speed, the process of preliminary deposition of soil into the trench at a low velocity and its subsequent compacting, consumes less power, allows reduction of the stress applied by the soil to the insulation coating surface, and increases the degree of soil compacting. The probability of the duct being damaged by soil compacting organs in the claimed method is reduced by providing a stable vehicle position in its displacement over the soil surface which has been prepared by a soil feeding organ.

In particular embodiments of the invention, one vehicle is used, which is made in the form of a base frame carrying the soil feeding, transport and soil compacting organs.

Furthermore, part of soil from the dump is used to form the above ground path. In addition, in formation of the ground path, its grading in the transverse direction is performed by skewing the soil feeding organ in the plane normal to the direction of its displacement. In addition, in order to counteract an angle of skewing of the vehicle that results from non-uniform subsidence of soil under the vehicle travelling unit, the transverse gradient of the ground path is set equal in value and opposite in its direction to the angle of skewing of the vehicle relative to the surface of the ground path as a result of the non-uniform subsidence of soil under its travelling unit. Furthermore, part of the soil from the transport organ is unloaded on the ground strip located between the vehicle travelling unit and the trench. In addition, the stress is applied to the soil for its compacting in a cyclic manner, the working elements of soil compacting organs being displaced in each compacting cycle in a plane normal to the direction of the vehicle displacement, in the downward direction and towards each other, whereas between the compacting cycles the working elements are moved in the displacement direction of the vehicle. In addition, the above working elements are rotated in the above-mentioned plane in the direction so the angle they define becomes smaller. In addition, during displacement of the working elements in the displacement direction of the vehicle, they are at least partially withdrawn from the soil. Furthermore, with the design force on the working elements, their actual position is determined, which is compared with the appropriate design position, and proceeding from the comparison results, the level of filling the trench with the soil is kept the same, or increased or lowered. In addition, the trench is filled with the soil up to the level which is higher than the level required for padding ground below a duct, while the displacement of the working elements in the displacement direction of the vehicle is performed with the working elements lowered into the soil. In addition with the design force on the working elements, their actual position is determined, which is compared with their appropriate design position, and proceeding from the comparison results, the level of lifting the working elements is kept the same, or increased or lowered. In addition, compacting the soil is performed with a constant maximal force on the working elements and specific pitch of compacting. Furthermore, the specific pitch of compacting is increased when increasing the maximal force on the working elements, and vice versa. In addition, the maximal force on the working elements is increased if the vehicle carrying the soil compacting equipment is skewed in the direction towards the trench, and vice versa.

Another goal of the invention is to provide a device for padding ground below a duct using excavated soil, by making rammer-type soil compacting organs which are hung to the vehicle using a disconnection mechanism and placing the soil feeding organ at an end face of the vehicle for formation of the soil surface over which the vehicle moves, to provide a minimal stress application by the soil on the insulation coating surface during padding ground with a greater degree of soil compacting, to lower the power consumption of the ground padding process and to eliminate damaging of the insulation coating by soil compacting organs.

The above goal is achieved by the device for padding ground below a duct using excavated soil, incorporating at least one vehicle with the travelling unit for displacement over the soil surface, which carries the equipment for filling the trench with the duct by excavated soil, including soil feeding and transport organs and a device for lifting-lowering the soil feeding organ relative to the vehicle, and equipment for compacting soil below a duct, including a soil compacting mechanism with drive soil compacting organs and a device for hanging soil compacting mechanism from the vehicle with the capability of forced displacement and rigid fastening relative to it in a plane which is normal to the direction of its displacement. According to the invention the soil feeding organ is located at the end face of the travelling unit and is wider than the travelling unit, and the device for hanging the soil compacting mechanism is fitted with a disconnection mechanism for cyclic displacement of soil compacting organs relative to the vehicle in its displacement direction, the soil compacting organs being of the rammer-type and being located behind the zone of soil unloading from the transport organ in the displacement direction of the vehicle.

Unlike the throwers, the rammer-type soil compacting organs are less power-consuming and provide a greater degree of soil compaction with a smaller damaging action of the soil on the insulation coating. The disconnection mechanism ensures normal functioning of soil compacting mechanism during continuous displacement of the vehicle whose stabilizing is provided by the soil feeding organ, thus lowering the probability of the damaging action of soil compacting organs on a duct.

In particular embodiments of the invention, the equipment for filling the trench with the duct by excavated soil is fitted with a device for forced rotation of soil feeding organ relative to the vehicle in a plane which is normal to the displacement direction of the vehicle. In addition, the equipment for filling the trench with the duct with excavated soil is made with at least two outlets for the soil, whose spacing in the horizontal direction normal to the direction of displacement of the vehicle is greater than the duct diameter. In addition, the device for hanging the soil compacting mechanism from the vehicle includes connected to each other mechanisms for forced lifting-lowering, transverse displacement and rotation of soil compacting mechanism. In addition, soil feeding, transport and soil compacting organs are hung from one vehicle made in the form of a base frame.

A goal of the invention is to provide equipment for padding ground below a duct with the capability of normal functioning of rammer-type soil compacting mechanism during continuous displacement of the vehicle by fitting the equipment with a disconnection mechanism.

This goal is achieved by the equipment for padding ground below a duct, including soil compacting mechanism and a device for hanging soil compacting mechanism to the vehicle, incorporating an integrated mechanism for forced displacement and rigid fastening of soil compacting mechanism relative to the vehicle in a plane normal to the direction of its displacement. According to the invention, the device is fitted with a disconnection mechanism for cyclic displacement of soil compacting organs relative to the vehicle in its displacement direction, which incorporates a kinematic joint which is included into a sequence of kinematic elements of the above-mentioned integrated mechanism, and has a degree of mobility in a plane which is parallel to the direction of the vehicle displacement.

In particular embodiments of the invention, the above-mentioned integrated mechanism incorporates the connected to each other mechanisms for forced lifting-lowering, transverse displacement and rotation of the soil compacting mechanism. In addition, the above-mentioned kinematic joint of the disconnection mechanism is made in the form of a hinge with the axis of rotation located in a plane normal to the direction of the vehicle displacement. In addition, the above-mentioned axis of rotation is located horizontally. In addition, the disconnection mechanism is fitted with at least one elastic element connected with the rigid elements which are connected to each other by the above hinge and form a kinematic pair. In addition, the disconnection mechanism is fitted with a longitudinal feed power drive connected to rigid elements which are connected to one another by the above hinge and form a kinematic pair. In addition, the integrated mechanism is made in the form of a lifting boom which with its root is connected by means of the first hinge and lifting-lowering power drive to the support mounted on the vehicle frame, and an arm which with its first end is connected by a kinematic connection, which includes the second hinge and transverse displacement power drive, to the head part of the lifting boom, and with its second end is connected by means of third hinge and power drive of revolution to the soil compacting mechanism, the above kinematic pair of the disconnection mechanism including the boom head part and a shackle which is connected to the first end of the arm by the above-mentioned second hinge.

Another goal of the invention is to provide a soil compacting mechanism by changing the connections and relative position of its elements, to provide displacement of soil compacting elements in the vertical and horizontal directions, which is sufficient for a high degree of compacting the soil below a duct and formation of a zone of soil compacting with slopes, in order to prevent breaking up of the soil with the duct resting on it, to provide soil compacting along the entire height of the space below the duct, in narrow trenches and at a great height, to provide lifting of soil compacting elements above the soil for their longitudinal feed with a stable position of soil compacting mechanism relative to the duct; to reduce the height of soil compacting mechanism for facilitating its introduction into/withdrawal from the trench.

This goal is achieved by the soil compacting mechanism incorporating the base which carries the drive soil compacting organs, each of which includes the connecting rod with the working element at its lower end, a lower lever which is joined to the connecting rod by its first hinge and to the base by the second hinge, and an upper lever which is connected by a third hinge to the upper end of the connecting rod. The upper lever is connected by the fourth hinge to the base, the fourth hinge being shifted relative to the second hinge in the direction of the connecting rod, and/or the distance between the first and third hinges is greater than the distance between the second and fourth hinges, and/or the distance between the third and fourth hinges is greater than the distance between the first and second hinges.

In particular embodiments of the invention, the working surfaces of the working elements in their upper position arc located horizontally or are facing each other and are located at an angle of not less than 90° to each other. In addition, the working surfaces of the working elements in their lower position define an angle which is in the range of 60 to 120°. Furthermore, the distance along the vertical between the working element of each soil compacting organ in its extreme upper and extreme lower positions is not less that half of the duct diameter, and the appropriate distance along the horizontal is not less than half of the above distance along the vertical. In addition, the base incorporates a beam and brackets which carry at least the upper and lower levers of soil compacting organs, and which are secured on the beam by detachable joints with the capability of placing them into at least two positions along the beam length. Furthermore, the power drive of each soil compacting organ is made in the form of a hydraulic cylinder hinged to the upper lever and the base. In addition, the upper levers are made as two arm and L-shaped levers, the mechanism being fitted with a synchronising tie rod hinged by its ends to second arms of upper levers.

BRIEF DESCRIPTION OF THE DRAWINGS

Other details and features of the invention will become obvious from the following description of its particular embodiments, with references to the accompanying drawings, which show.

DETAILED DESCRIPTION OF THE PREFERRED EMBODIMENTS

Figure 1:
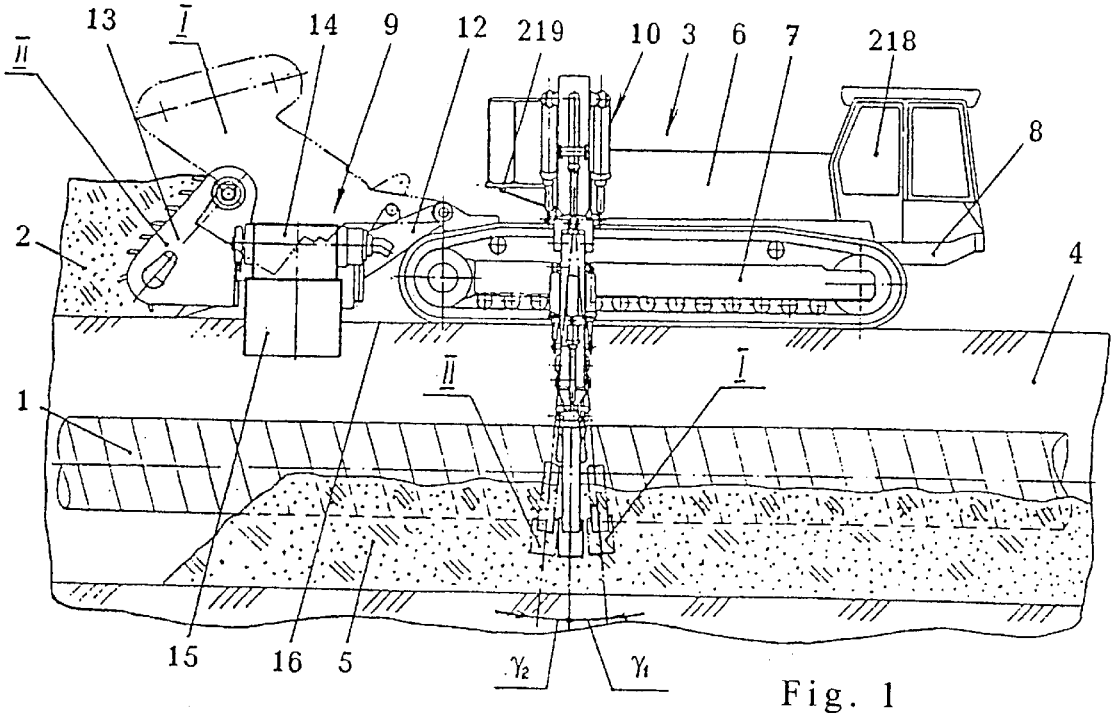
FIG. 1—preferable embodiment of the claimed device in the form of a machine for padding ground below a duct using excavated soil with left-handed position of suspended equipment, side view.

The claimed method of padding ground below duct 1 with excavated soil 2 can be implemented in its preferable embodiment using the appropriate claimed device which in its preferable embodiment is made in the form of machine 3 for padding ground below a duct using excavated soil (further on referred to as machine 3), as is described further and explained by the drawings. In this case, the term padding ground below a duct using excavated soil, is used in the sense of filling trench 4 with duct 1 by excavated soil 2 and its compacting, at least, in space 5 below duct 1.

Machine 3 consists of a vehicle which in this case is made in the form of one common base frame 6 with caterpillar unit 7 for displacement over the soil surface, hung to whose frame 8 are equipment 9 for filling the trench with the duct with excavated soil (further on referred to as filling equipment 9) and equipment 10 for soil compacting below a duct (further on referred to as compacting equipment 10). It is obvious to an expert that the claimed device for padding ground below a duct using excavated soil, can be made as a system of two machines (not shown in the drawing), in which case it will have two vehicles—caterpillar base frames, one of them carrying filling equipment 9 and the other—compacting equipment 10.

Figure 5:
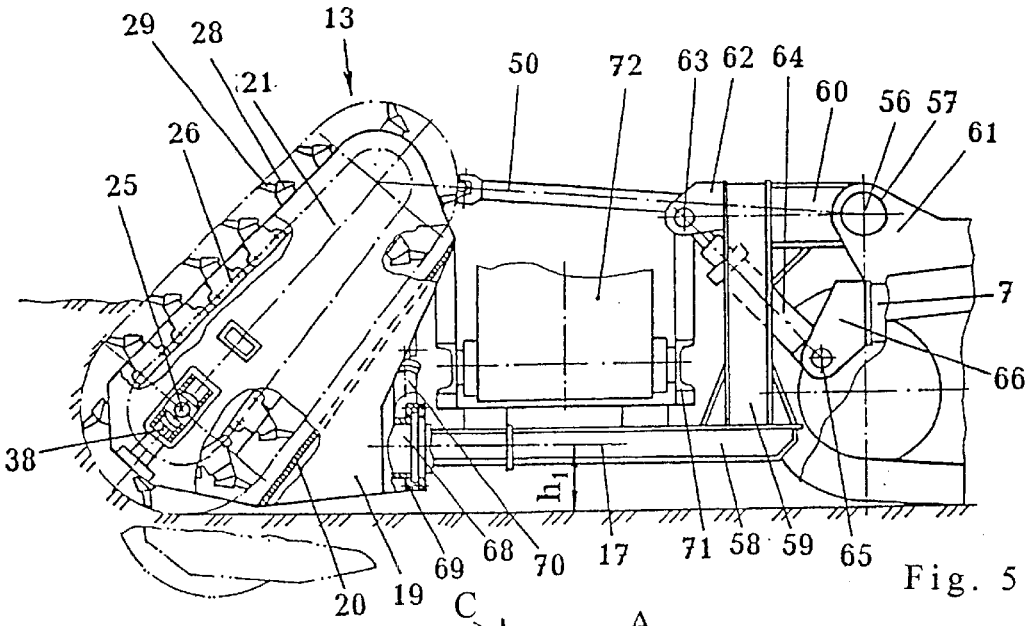
FIG. 5—preferable embodiment of the equipment for filling the trench with excavated soil, side view.
Figure 7:
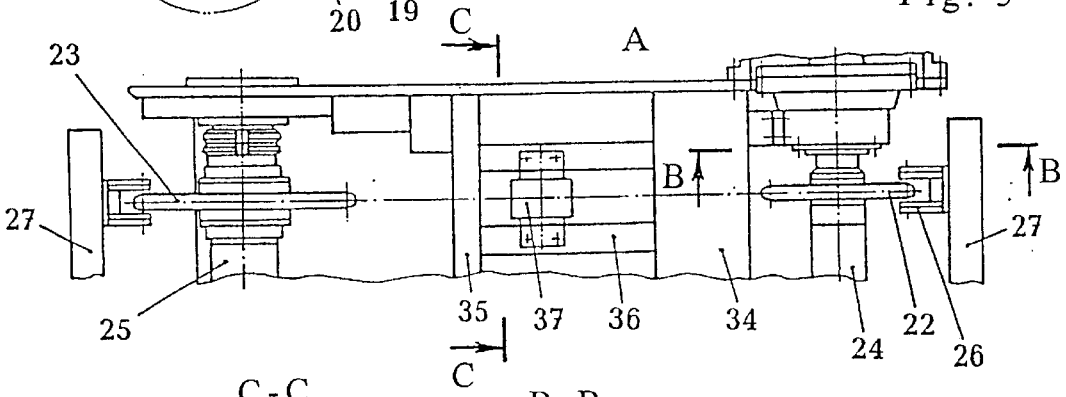
FIG. 7—component A in FIG. 6.
Figure 6:
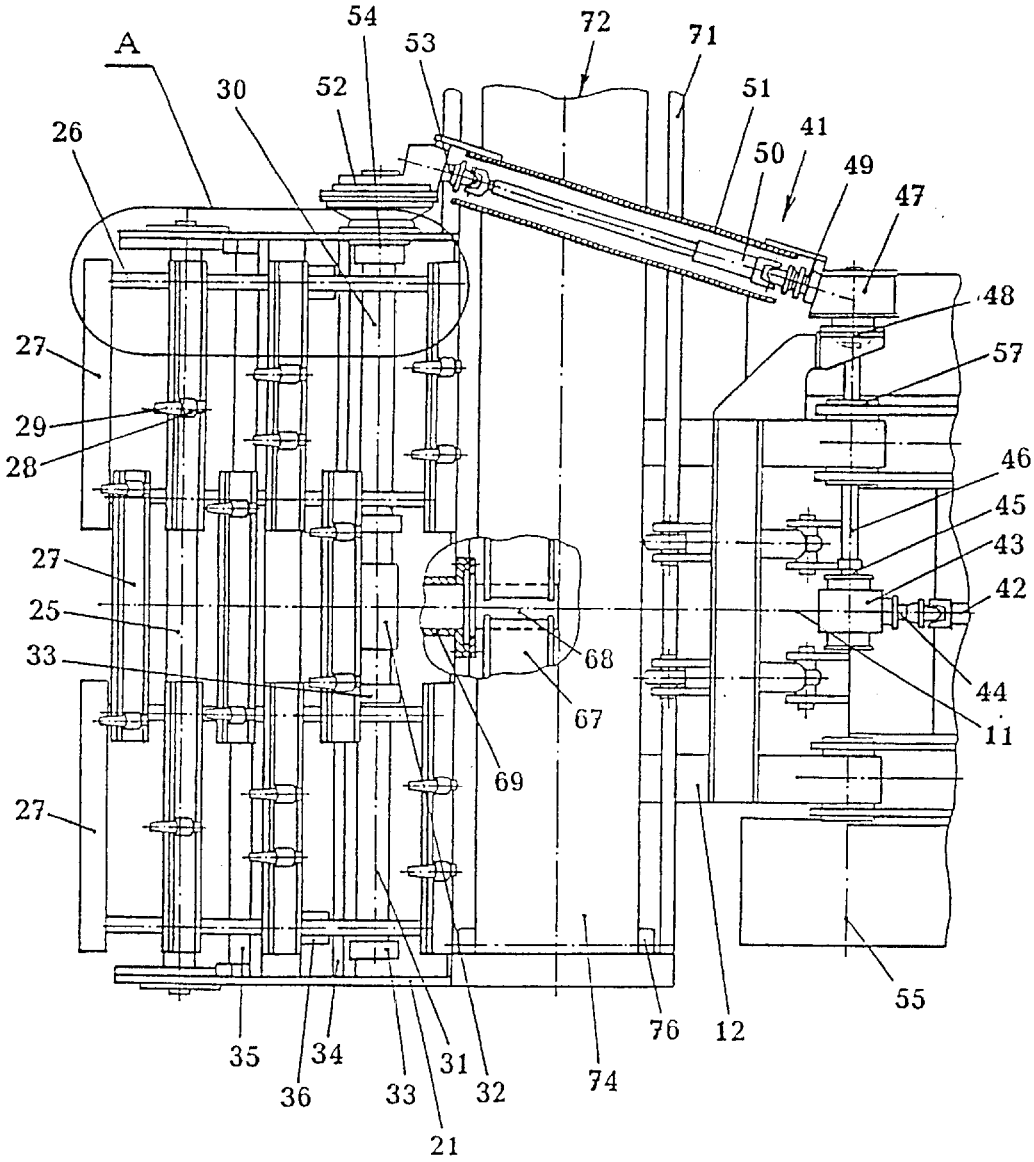
FIG. 6—same, top view.

Filling equipment 9 is made in the form of an earth-moving and transportation device for picking-up soil and feeding it upwards and in the direction which is normal to longitudinal axis 11 of base frame 6 (further on referred to as transverse direction). Filling equipment 9 includes a device for lifting-lowering soil feeding organ relative to the vehicle (base frame 6) which incorporates frame 12 hung to frame 8 of base frame 6, with the capability of forced lifting and forced or gravity lowering (further on referred to as lifting frame 12), soil feeding 13 and transport 14 organs, as well as soil divider 15 located in the zone of soil unloading from transport organ. Soil feeding 13 and transport 14 organs are mounted on lifting frame 12. Soil feeding organ 13 is made with the capability of continuously feeding excavated soil 2 or newly unturned ground and is located at the end face of base frame 6, its width $L_{b1}$, being greater than the width $L_{b2}$ of caterpillar travelling unit 7 of base frame 6 so that the surface of the soil formed by the soil feeding organ 13 after its passage, makes a ground path 16 of sufficient width for displacement of travelling unit 7 over it. For grading the path 16 in the transverse direction, soil feeding organ 13 is connected to travelling unit 7 with the capability of its forced rotation in a plane normal to longitudinal axis 11 of base frame 6 (further on referred to as transverse plane). Filling equipment 9 can have different design embodiments, for instance, soil feeding 13 and transport 14 organs can be mounted with the ability of simultaneous rotation about an imaginary geometrical axis of rotation 17 (further on axis of rotation 17), or as shown in FIGS. 5, 6, only the soil feeding organ is mounted with the ability of revolution about axis of rotation 17. In this case, in order to reduce the lateral linear displacement of lower part of soil feeding organ 13 when forming ground path 16, in its revolution about axis of rotation 17, the vertical distance $h_1$ (FIG. 5) from the axis of rotation 17 to the surface of the ground path 16 should be minimal.

In the general case, soil feeding organ 13 can be made of different types, for instance, chain, rotor, screw-conveyor or combined, the most preferable embodiment, however, being the chain variant of soil feeding organ 13, with widegrip soil feeding chain 18. In this case soil feeding organ 13 incorporates frame 19 with inclined flat breast 20 and side panels 21 between which soil feeding chain 18 is located, mounted on drive 22 and tension 23 sprockets of drive 24 and tension 25 shafts. Soil feeding chain 18 is formed in the preferable embodiment, as shown in the drawings (FIGS. 2, 3, 6), by four hauling chains 26 bending to one side, which are connected to each other by soil transporting beams 27 which are arranged in three rows, with beams in adjacent rows shifted along and overlapping across soil feeding chain 18. In other embodiments. the number of hauling chains 26 and of rows of soil transporting beams 27, respectively, can be larger or smaller. Replaceable cutters 29 are mounted on beams 27 in cutter holders 28. Drive shaft 24 preferably consists of right 30 and left 31 co-axial half-shafts which are connected to each other by gear-type or other coupling 32. On each of the half-shafts 30, 31 two drive sprockets 22 are tightly fitted, outside which bearing supports 33 are located by means of which half-shafts 30, 31 are mounted on first transverse beam 34 of frame 19. Beam 34 is fixedly connected by its end faces to side panels 21. Longitudinal beams 36 which carry rollers 37 supporting hauling chains 26, are located between and connected by their end faces to first transverse beam 34 and second transverse beam 35 which is shifted towards tension shaft 25 relative to the first transverse beam. Tension sprockets 23 are mounted by means of bearings on a one-piece tension shaft 25 connected by its ends to side panels 21 by tension mechanisms 38. In an alternative embodiment (not shown in the drawings) the tension shaft can be absent, and tension sprockets 23 can be mounted on a tension beam connected by its ends to side panels 21 by the tension mechanisms 38.

Figure 9:
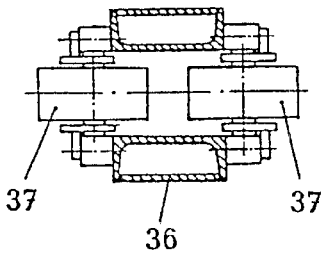
FIG. 9—C—C cut in FIG. 7.
Figure 8:
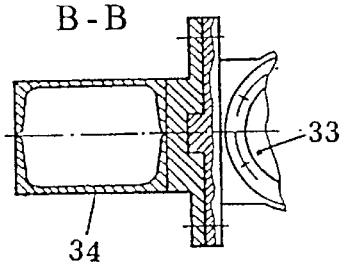
FIG. 8—B—B cut in FIG. 7.

One of half-shafts 30, 31 of drive shaft 24, for instance, the right one 30 (FIG. 9) is connected to drive 39 which can be made, for instance, in the form of hydraulic motor 40, as shown in FIG. 1, or as in the preferable embodiment in FIG. 6, in the form of a mechanical transmission 41 connected to the power take-off shaft (PTO) (not shown in the drawings) of base frame 6. Mechanical transmission 41 incorporates successively arranged in the direction of transfer of the torque and connected to each other first cardan shaft 42, first reduction gear 43 with input 44 and output 45 shafts normal to each other, second reduction gear 47 with input 48 and output 49 shafts located at an angle to each other, second cardan shaft 50 which is made to be telescopic and enclosed into casing 51, and third reduction gear 52 with input 53 and output 54 shafts located at an angle to each other. Output shaft 45, input shaft 48 and the shaft 46, which is connected to them by its ends, are co-axial with an imaginary geometrical axis 55 of rotation of hinges 56 by which frame 12 of filling equipment 9 is hung to frame 7 of base frame 6. In this case, the axle 57 of hinge 56 (the right one in FIG. 6), is made tubular with a through hole for passing shaft 46 through it.

In the preferable embodiment of the invention (FIGS. 5, 6), frame 12 includes first part 58 located horizontally as shown in the drawings nominal working position of filling equipment 9 and located normal to the first part and fixedly connected to it second part 59 whose upper end accommodates located normal to it, first brackets 60 which by means of above hinges 56, are connected to brackets 61 mounted on frame 7. Made on the upper end of second part 59 are second brackets 62 located opposite to first brackets 60 relative to this part, to which second brackets the rods of hydraulic cylinders 64 for forced lifting-lowering of frame 12, arc connected by means of axles 63. The lifting hydraulic cylinders 64 are connected by means of axles 65 to brackets 66 made fast on frame 7. Fastened rigidly on the front transverse beam 67 of first part 58 of frame 12 is tubular axle 68 whose imaginary geometrical axis is the axis of rotation 17 and is located in all positions in one plane with longitudinal axis 11 of base frame 6, and in the earlier mentioned nominal working position is approximately parallel to longitudinal axis 11. In this case, frame 19 of soil feeding organ 13 is fitted with bushing 69 which encloses front cantilever part of tubular axle 68 and is hinged to first part 58 of frame 12 by means of hydraulic cylinders 70 for forced rotation of soil feeding organ 13 about axis of rotation 17. Hydraulic cylinders 70 of rotation are located under breast 20, thus making the design of filling equipment 9 compact and preventing soil from falling on the hydraulic cylinders 70.

Figure 2:
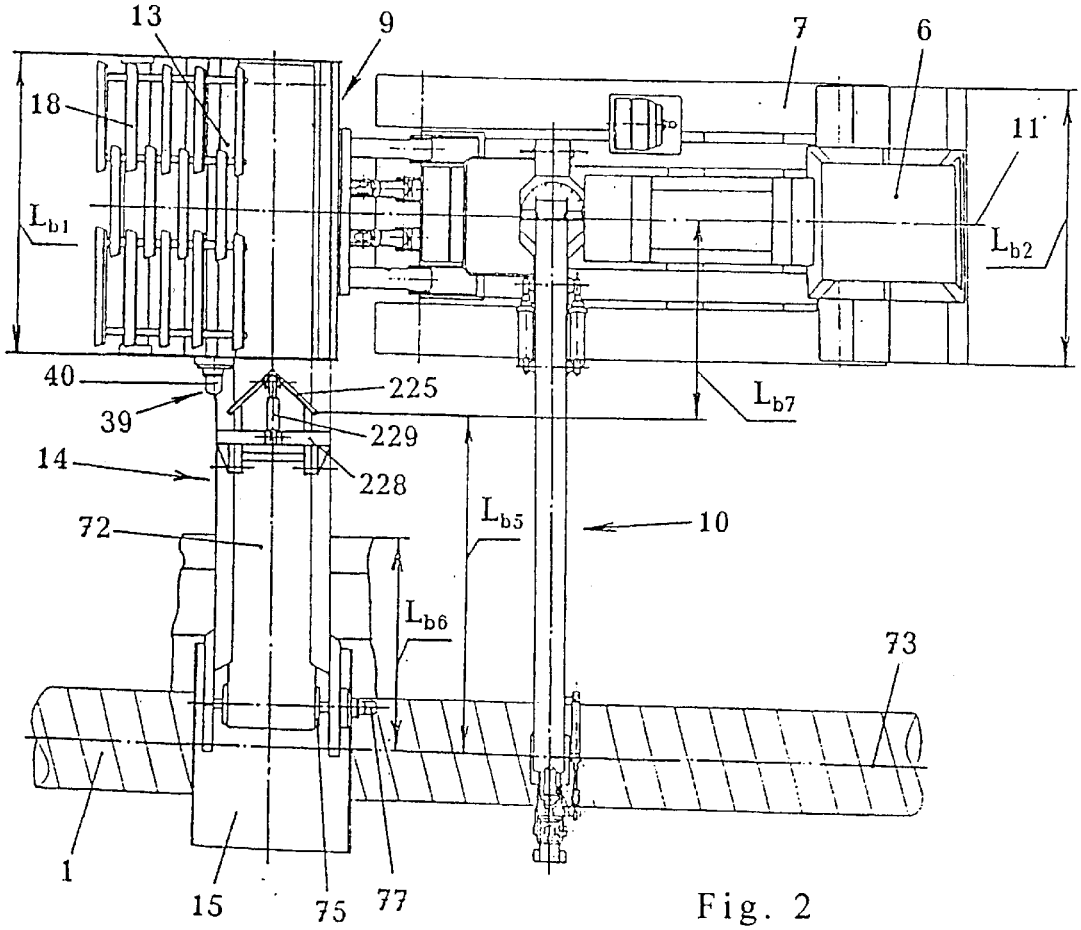
FIG. 2—same, top view.
Figure 3:
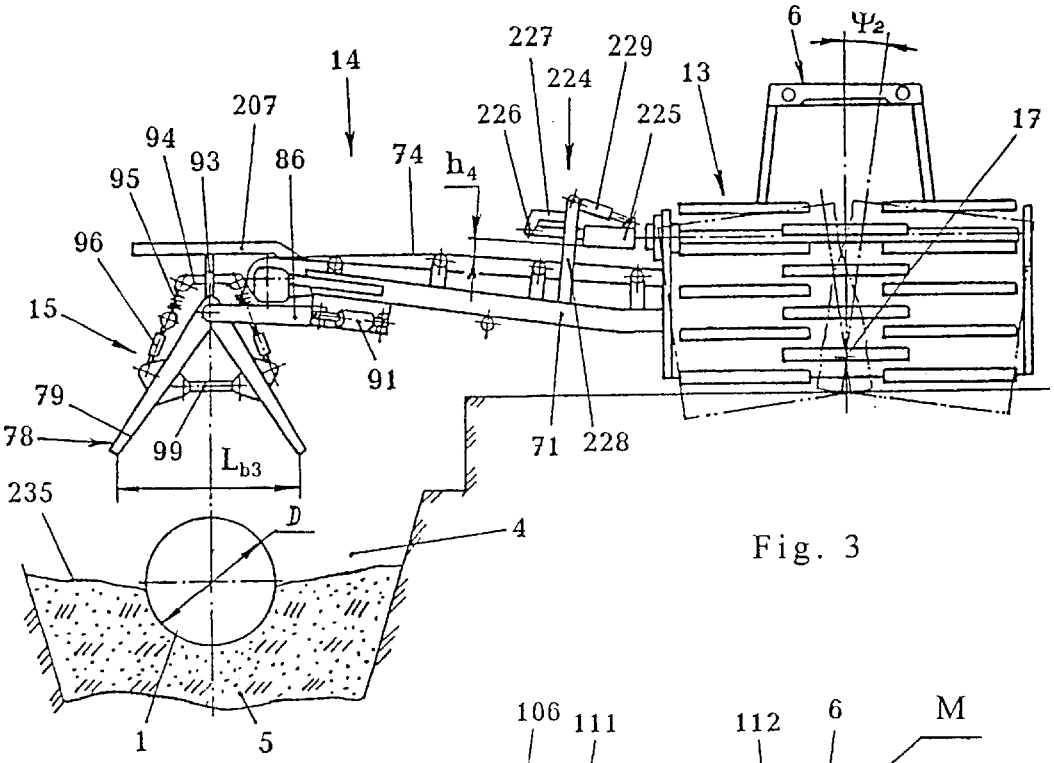
FIG. 3—machine for padding ground below a duct using excavated soil with right-handed position of suspended equipment, front view of filling equipment.

In the preferable embodiment shown in the drawings, the transport organ 14 has a frame 71 of the belt conveyor 72located in the transverse plane (normal to longitudinal axis 11 of the base frame), and is fastened on the first part 58 of frame 12 by a detachable joint. In this case, the detachable joint allows placing belt conveyor 72 in one of the two positions with the extension to the right (in FIGS. 3, 4, 6) or to the left (in FIGS. 1, 2) of longitudinal axis 11. Extension of conveyor 72 corresponds to the nominal distance from longitudinal axis 11 to longitudinal axis 73 of duct 1. Belt conveyor 72 is of the standard known design and includes continuous belt 74, two drums 75, 76 enveloped by belt 74, and drive of drum 75 made, for example, in the form of hydraulic motor 77 (FIG. 2).

Figure 12:
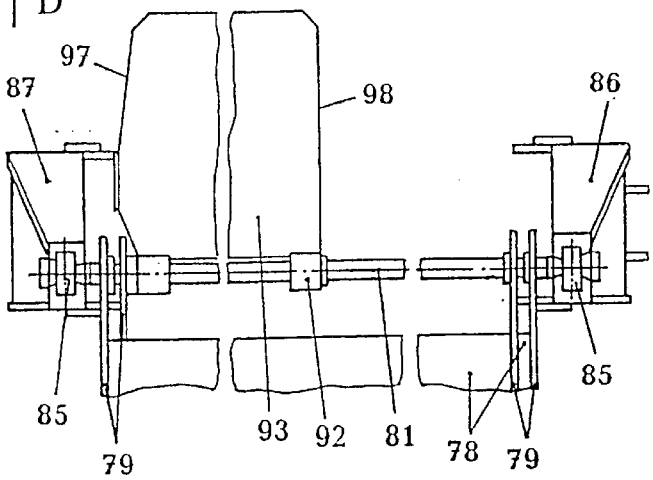
FIG. 12—view D in FIG. 10.
Figure 13:
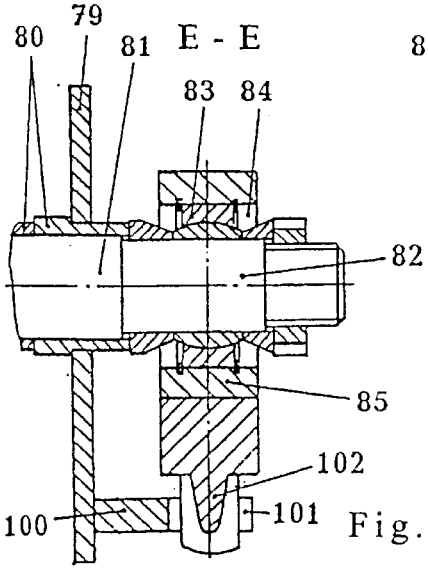
FIG. 13—E—E cut in FIG. 10.

Soil divider 15 preferably has the form of a gable roof and incorporates trays 78 inclined in the transverse plane with edges 79, which are mounted on bushings 80 with the capability of rotation on axle 81 whose end parts 82 are mounted on spherical hinge bearings 83 in holes 84 of brackets 85 which are made on the first ends of levers 86, 87. Second ends of levers 86, 87 are hinged to frame 71 of belt conveyor 72 by means of practically vertical axes 88. Second end of lever 86 is fitted with bracket 89 which is hinged by axle 90 to the rod of hydraulic cylinder 91 for adjustment of the proportion of. soil flows coming out of divider 15. The hydraulic cylinder of adjustment 91 is hinged to frame 71 of conveyor 72. Mounted on axle 81 with a shift towards one of its ends, by means of bushings 92 with the capability of rocking, is cutoff shield 93 with brackets 94 which are connected by means of extension springs 95 and adjusting turn buckles 96 to edges 79 of trays 78. The left (in FIG. 12) end face 97 of cut-off shield 93 comes practically right up to the left edges 79, whereas the right end face 98 is located approximately half way between the left and right edges 79. Trays 78 are located at an angle to each other and fixed in such a position by distance piece 99 whose ends are hinged to trays 78, with a distance $L_{b3}$ (FIG. 3) between lower end faces of trays 78 which are outlets for soil coming out of filling equipment 9, the distance $L_{b3}$ being greater than diameter D of the duct in the horizontal transverse direction. One of edges 79 of one of trays 78 has a welded-on plate 100 with slot 101 which accommodates the rest 102 made on one of brackets 85. The width of slot 101 is larger than the respective dimension of the rest 102, thus providing the capability of simultaneous rocking of trays 78 on axle 81 for their gravitational self-positioning at the same angle to the horizon. Levers 86, 87 with hydraulic cylinder of adjustment 91 and their appropriate connections, represent a mechanism for displacement of soil divider 15 relative to conveyor 72 in the direction out of the plane of location of the latter. It is obvious that the above mechanism can also be of another design which provides appropriate displacement of divider 15. Furthermore, it is obvious that the proportion of soil flows can be changed not only by displacement of entire divider 15, but also by displacement along axle 81 of solely cut-off shield 93 with trays 78 being stationary relative to conveyor 72.

Compacting equipment 10 includes soil compacting mechanism 103 with two drive rammer-type soil compacting organs 104, 105 and device 106 for hanging to base frame 6 (vehicle) soil compacting mechanism 103 (further on referred to as suspension device).

Suspension device 106 includes integrated mechanism 107 for forced displacement and rigid fastening of soil compacting mechanism 103 relative to base frame 6 in the transverse plane, which preferably includes the connected to each other mechanisms for lifting-lowering 108, transverse displacement 109 and rotation 110 of soil compacting mechanism 103. In the preferable embodiment of integrated mechanism 107, above-mentioned mechanisms 108, 109, 110 are made as follows.

Lifting-lowering mechanism 108 is made in the form of lifting boom 111 which with its root 112 by means of first hinge 113 is connected to bracket 114 with base plate 115 which has pin 116 in its center, located in the hole of horizontal base plate 117 of a support which is rigidly fastened on frame 8 of base frame 6 and is made in the form of gantry 118. Base plates 115, 117 are fastened to each other by bolts 119 with nuts 120 and washers 121, with elongated slots 122 made in base plate 114 for above bolts 119, thus providing the capability of rotation of bracket 114 about imaginary geometrical axis 123 of pin 116 when nuts 120 are loosened. Lock 124 is provided for a reliable securing of bracket 114 against rotation about axis 123, the lock being made in the form of plate 125 with toothed quadrant 126, tooth 127 and slots 128 for bolts 129. Scale 130 and toothed quadrant 131 are made on base plate 115 for engagement with toothed quadrant 126, while gantry 118 has welded to it base plate 132 with radial slot 133 for accommodating tooth 127 and threaded holes 134 for bolts 129. Base plate 115 has additional toothed quadrant (not shown in the drawings) which is shifted relative to main toothed quadrant 131 by an angle of 180°, thus providing for positioning of lifting boom 111 with extension to the left or to the right of longitudinal axis 11 of base frame 6. By means of lifting-lowering hydraulic cylinder 135, boom 111 is hinged to left 136 or right 137 posts of gantry 118, respectively.

The mechanism of transverse displacement 109 is made in the form of arm 138 whose first end 139 is connected to head part 140 of boom 111, which is made L-shaped. In this case, the above-mentioned connection includes second hinge 141, and hydraulic cylinder 142 of transverse displacement. Brackets 143, 144 are made on first end 139 of arm 138 and head part 140 of boom 111, the brackets being connected by hinges 145, 146 to rod and case of hydraulic cylinder 142, respectively. Second (lower) end 147 of arm 138 is connected by means of a third hinge 148 to base 149 of soil compacting mechanism 103.

Rotation mechanism 110 is made in the form of above-mentioned hinge 148 and hydraulic cylinder 150 of rotation, whose rod and case are connected by means of hinges 151, 152 to base 149 and arm 138, respectively.

Figure 4:
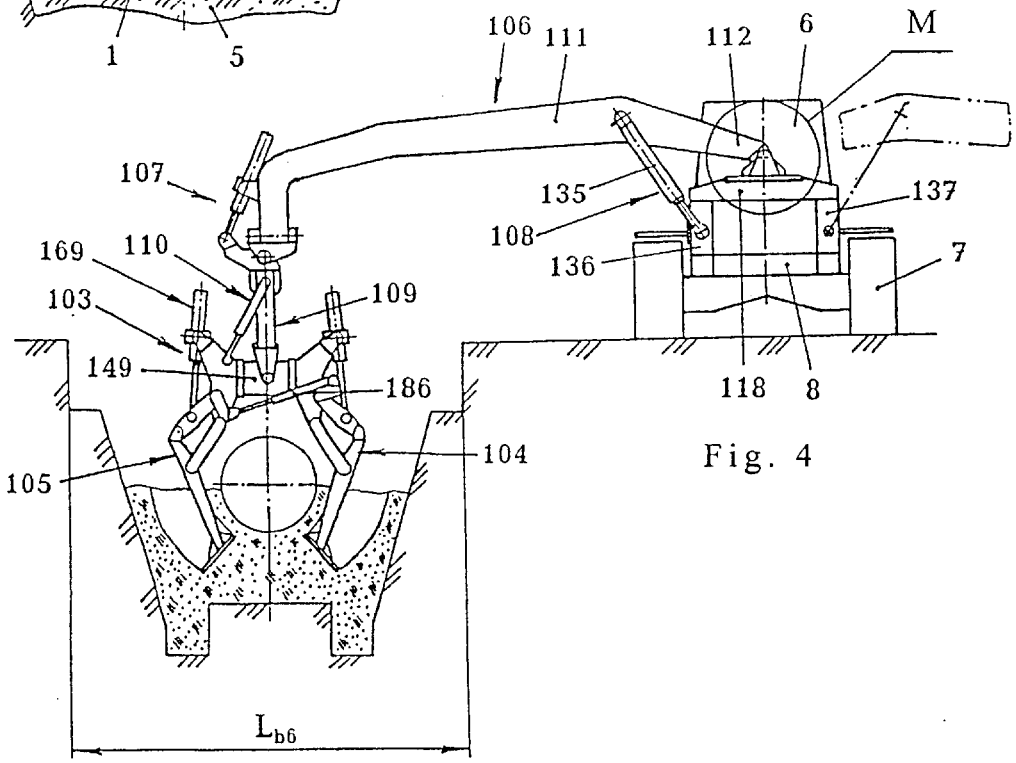
FIG. 4—same, front view of compacting equipment.
Figure 14:
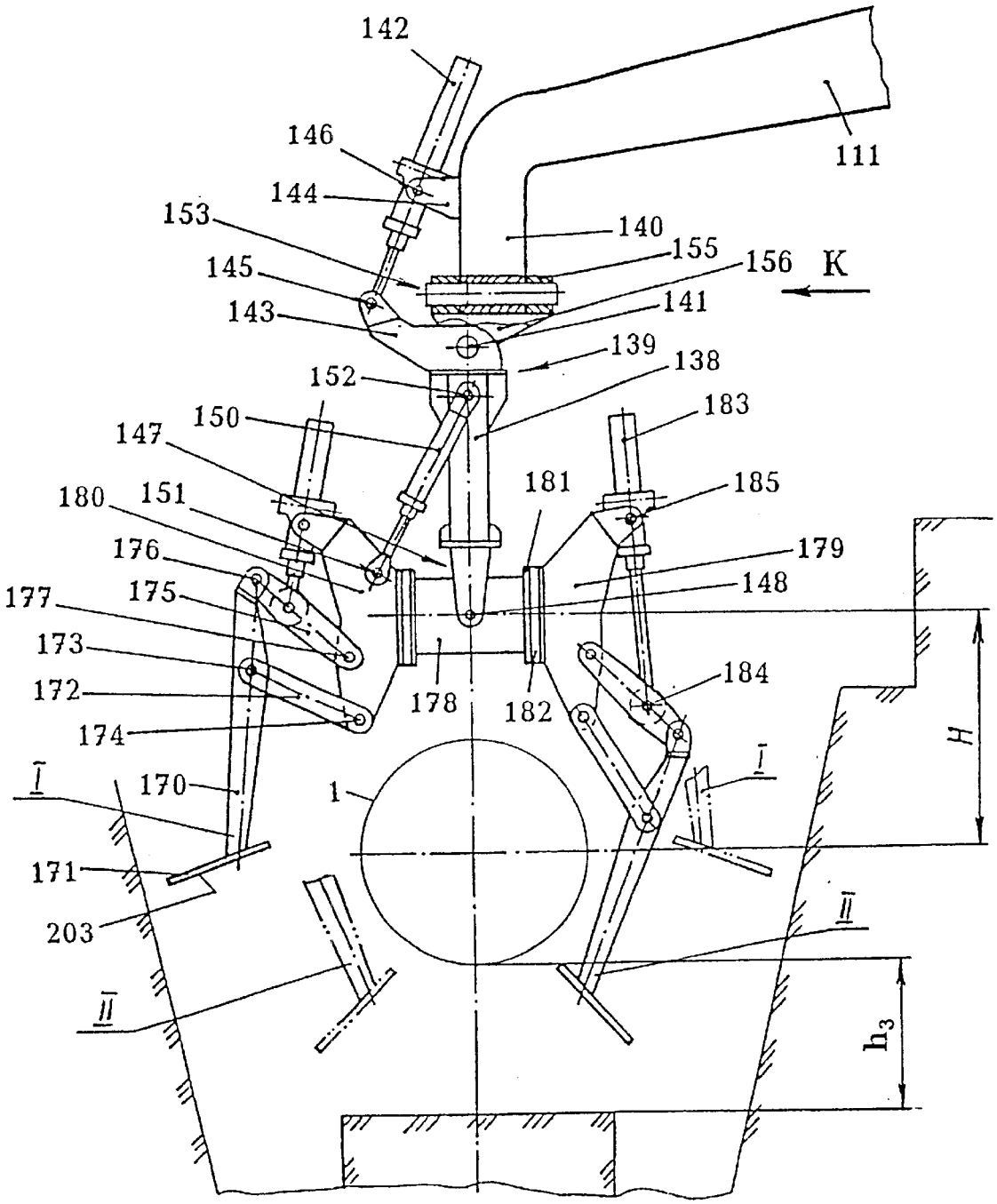
FIG. 14—preferable embodiment of the equipment for soil compacting below a duct, rear view.
Figure 15:
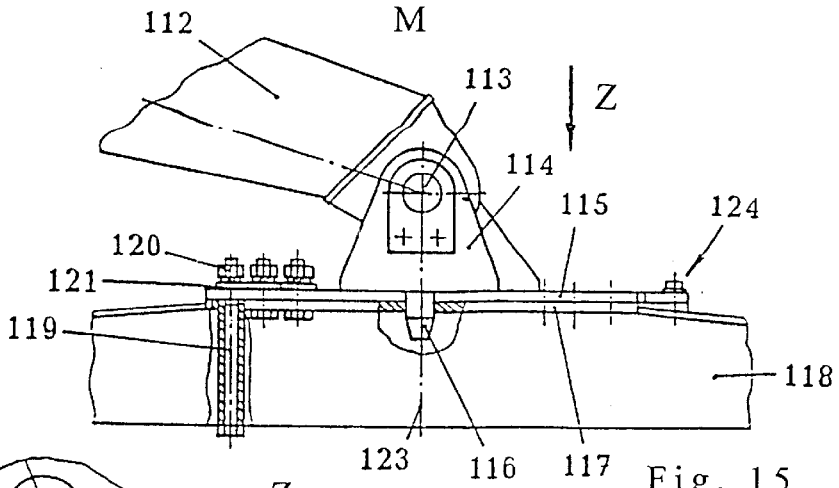
FIG. 15—component M in FIG. 4.
Figure 16:
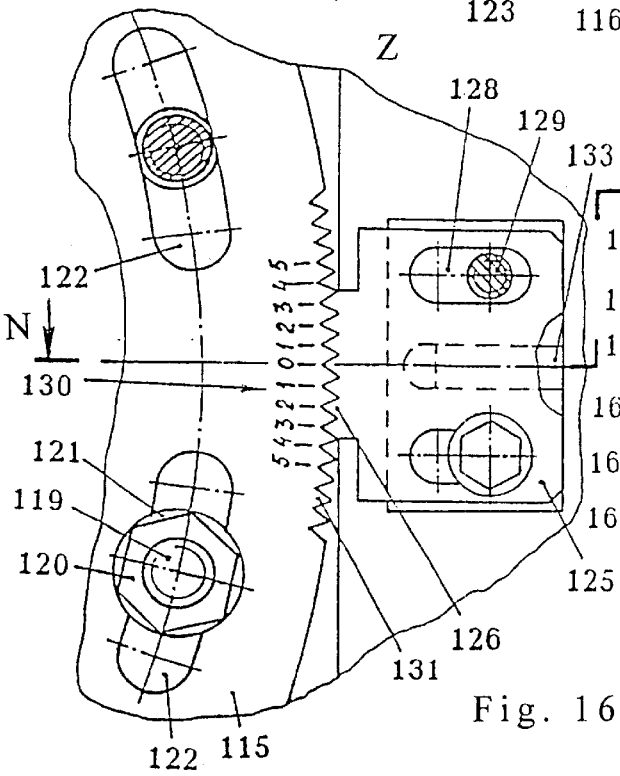
FIG. 16—Z view in FIG. 15.

Suspension device 106 further incorporates a disconnection mechanism 153 for cyclic displacement of soil compacting organs 104, 105 relative to base frame 6 in its displacement direction, thus providing the capability of soil compacting during continuous displacement of base frame 6. Disconnection mechanism 153 is made in the form of hinge 154 which connects to each other head part 140 of boom 111 and shackle 155 which has lugs 156 connected by hinge 141 to arm 138. That is, in this embodiment of suspension device 106 the connection of arm 138 with head part 140 of boom 111 includes, beside hinge 141 and hydraulic cylinder 142, hinge 154 and shackle 155. In other embodiments, however, hinge 154 can be connected at another point into the sequence of kinematic elements join in soil compacting organs 104, 105 to base frame 6. The geometrical axis of hinge 154 is located in the transverse plane, and is practically horizontal in the working position of compacting equipment 10 (FIGS. 4, 14). Geometrical axes of all hinges 113, 141, 148 of integrated mechanism 107 are located longitudinally, i.e. normal to the above transverse plane. Thus, in forced closure of hinges 113, 141, 148 by means of hydraulic cylinders 135, 142, 150 a rigid connection of soil compacting mechanism 103 with base frame 6 in the transverse plane is in place, i.e. any kind of its spontaneous displacement is eliminated. In this embodiment disconnection mechanism 153 is serviceable without any additional elements. It, however, can include elastic elements, made, for instance, in the form of spring adjustable shock absorbers 157. Each shock absorber 157 is made in the form of rod 158 with threaded 159 and smooth 160 sections which carry stationary 161 and mobile supports 162 between which compression spring 163 is mounted. Mobile support 162 has spherical pivot 164 supported by plate 165 with a hole, which is welded on shackle 155, whereas rod 158 has lug 166 connected by axle 167 to bracket 168 which is welded on head part 140.

Soil compacting mechanism 103 includes base 149 on which are mounted soil compacting organs 104, 105 and power drive 169 of soil compacting organs 104, 105. Each soil compacting organ 104, 105 includes connecting rod 170 which has flat working element 171 attached to its lower end, lower lever 172 which is connected by first hinge 1773 to connecting rod 170, and by second hinge 174 to base 149, and upper lever 175 which by third hinge 176 is connected to upper end of connecting rod 170, and to base 149 by fourth hinge 177. In this case, in order to provide downward displacement towards each other of elements 171, at least one of the following three conditions must be satisfied: the fourth hinge 177 should be shifted relative to second hinge 174 towards the connecting rod 170, or; the distance between first 173 and third 176 hinges should be greater than the distance between second 174 and fourth 177 hinges, or; the distance between third 176 and fourth 177 hinges should be greater than the distance between first 173 and second 174 hinges. It is natural that simultaneous satisfying of two or preferably three of the above-mentioned conditions is possible, as in the preferable embodiment of the soil compacting mechanism shown in FIGS. 4, 14, 19. Base 149 is made composite and includes beam 178 and two brackets 179, 180 which carry all the elements of soil compacting organs 104, 105. Brackets 179, 180 are fastened by flange joints 181 through replaceable inserts 182 on end faces of beam 178. Replaceable inserts 182 are designed for changing the spacing of brackets 179, 180, when the mechanism is set up for a particular duct diameter. Power drive 169 of each soil compacting organ 104, 105 is made in the form of hydraulic cylinder 183 whose rod and case are connected by hinges 184, 185 to upper lever 175 and bracket 179 or 180, respectively.

Figure 19:
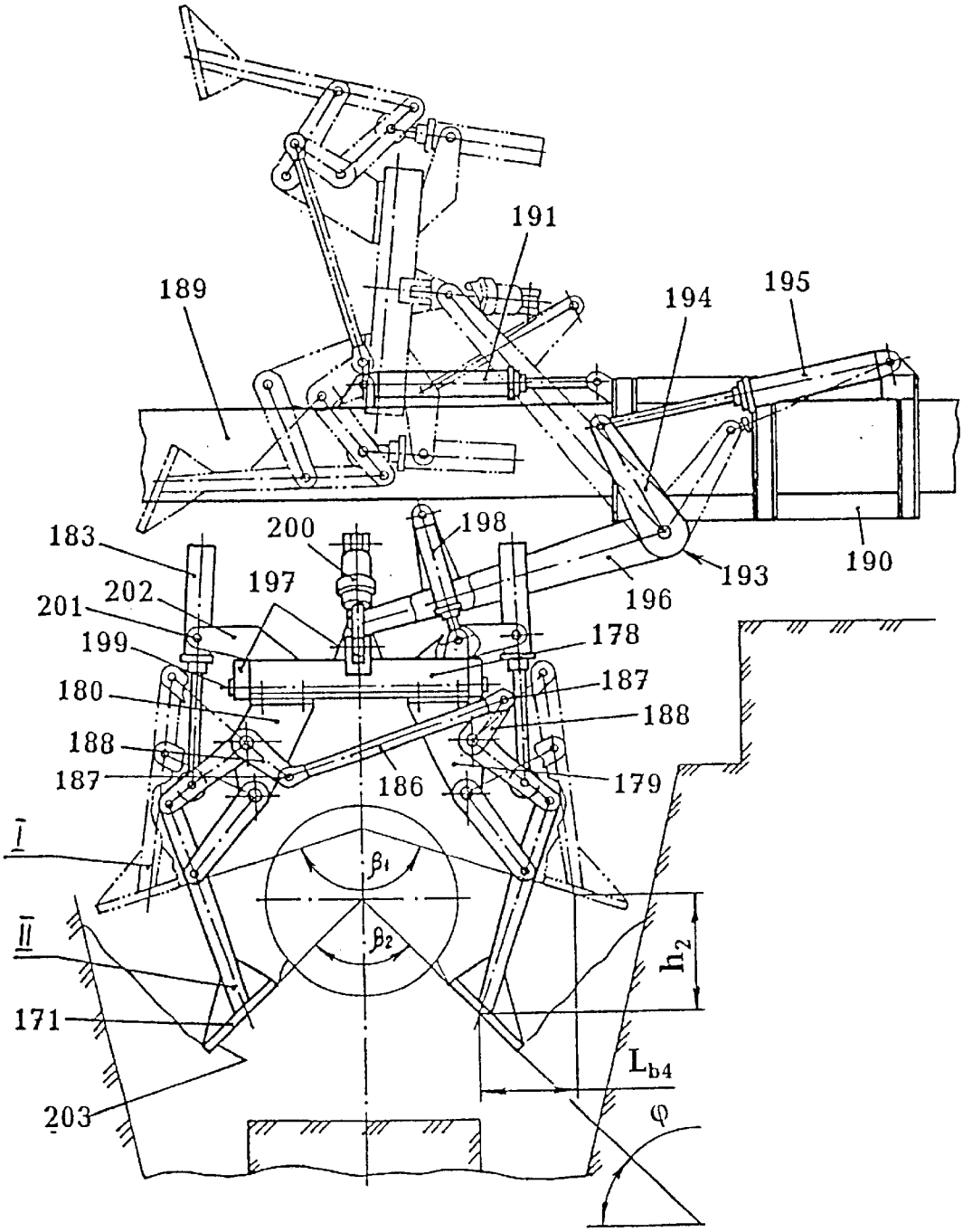
FIG. 19—an embodiment of the equipment for soil compacting below a duct, rear view.
Figure 20:
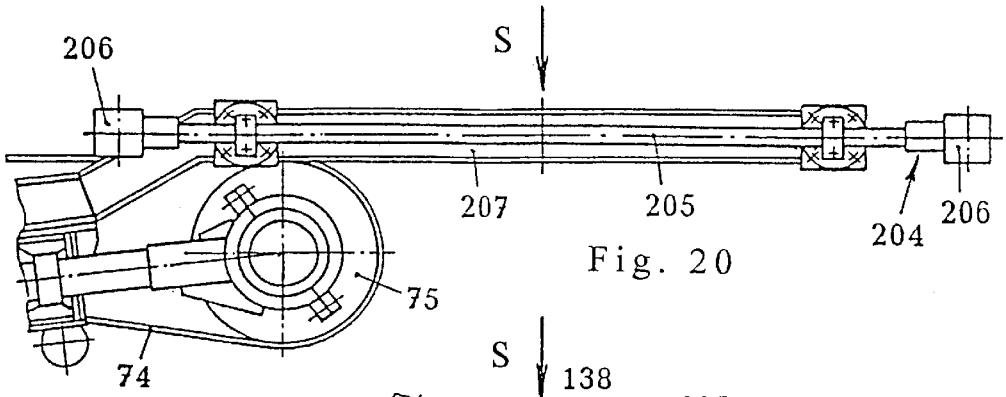
FIG. 20—mounting a contactless sensor of the duct position on a belt conveyor.

In the above described and shown in FIG. 14 embodiment, soil compacting mechanism is fully serviceable; for synchronism the displacement of soil compacting organs 104, 105, however, it is rational to make upper levers 175 as two-arm and L-shaped levers, and fit the mechanism with synchronising tie rod 186, connected by its ends to second arms 188 of upper levers 175 by hinges 187, as shown in FIGS. 4, 19. It is rational to make hinges 145, 151, 152, 184 using standard spherical hinge bearings, and to make hinges 146, 185 using double hinges of Hooke's joint type.

FIG. 19 shows another embodiment of compacting equipment 10, in which suspension device 106 includes load-carrying structure 189 which is made in the form of a cantilever beam-made fast on base frame 6, or in the form of a semi-gantry cross-bar resting at one end (for instance right end, FIG. 19) on frame 8 of base frame 6 which is located, for instance, on the right berm of the trench, and at the second end supported by its own caterpillar carriage which is located on the opposite (left) berm of trench 4. In this case, mechanism 109 of transverse displacement is made in the form of a carriage 190 that is mobile along a load-carrying structure 189 and hydraulic cylinder 191 of transverse displacement. Lifting-lowering mechanism 108 is made in the form of a hinged to the carriage 190 two-arm L-shaped lever 193 whose first arm 194 is hinged to lifting-lowering hydraulic cylinder 195, and whose second, arm 196 is hinged to cross-piece 197. Rotation mechanism 110 is made in the form of a hinge joining second arm 196 of lever 193 to cross-piece 197 and hydraulic cylinder 198 of rotation. Disconnection mechanism 153 is made in the form of hinge joint 199 of cross-piece 197 with base 149 of soil compacting mechanism 103 and hydraulic cylinder 200 hinged to cross-piece 197 and base 149. In this case, axis of rotation of hinge joint 199 in the nominal working position shown in FIG. 19 is located horizontally and in the transverse plane (plane of the drawing in FIG. 19).

Soil compacting mechanism 103 represented in FIG. 19, differs from the one described above and shown in FIG. 14 in that brackets 178, 180 are fastened on lower plane of beam 178 of base 149 with the ability of moving them into several positions along the length of beam 178. Hydraulic cylinders 183 are connected by hinges 201 of a standard design to additional brackets 202 made fast on upper plane of beam 178.

It is rational to make soil compacting mechanism so that working surfaces 203 of working elements 171 in their upper position I (FIGS. 14, 19) were located horizontal or faced each other at angle $\beta_1$ which is not less than 90°. Furthermore, it is rational for working surfaces 203 of working elements 171 in their lower position II to be located at angle $\beta_2$ to each other, which is in the range of 60° to 120°. In addition, it is rational to assume such a ratio of the dimensions of the elements of soil compacting mechanism, that vertical displacement $h_2$ of working elements 171 was not less than half of diameter D of the duct, horizontal displacement $L_{b4}$ was not less than half of vertical displacement $h_2$ and in the extreme lower position II, at least the greater part of working surface 203 of working elements 171 was located below duct 1.

Device of monitoring and control of machine 3 is fitted with means 204 for monitoring the position of base frame 6 relative to duct 1 in the vertical and horizontal transverse directions. It is obvious that the means 204 can be made in the form of a mechanical tracking system which has means for mobile contact with the duct surface, for instance, rollers connected with displacement sensors (not shown in the drawings). Such a mechanical system, however, would be too inconvenient in service, prone to damage and different malfunctions in operation. In the preferable embodiment of the invention, means 204 is made in the form of block of receiving aerials 204 which are usually used in devices such as pipe finders, cable finders or pipeline route finders, and which use the electromagnetic field induced around the duct by alternating electric current passing through it. Block of receiving aerials 204 consists of a tubular rod 205, at the ends of which are mounted two cases 206 with magnetic receivers which are inductance coils.

Block of receiving aerials 204 is mounted on cantilever 207 which is made fast on frame 71 of conveyor 72, with cases 206 located symmetrical to axle 81 of soil divider 15.

Figure 23:
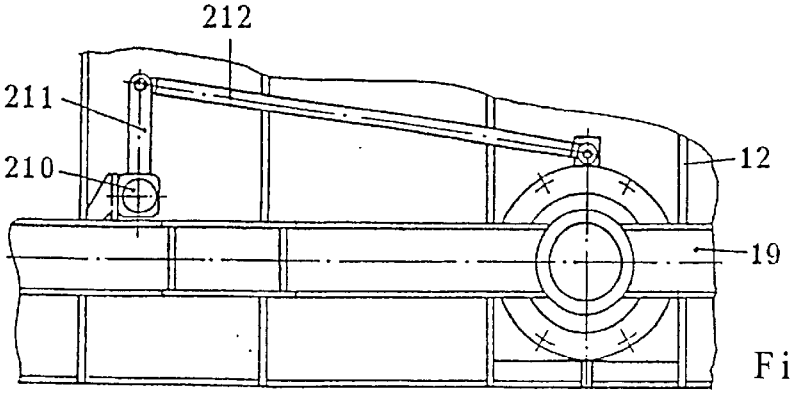
FIG. 23—mounting the sensor of soil feeding organ rotation.
Figure 24:
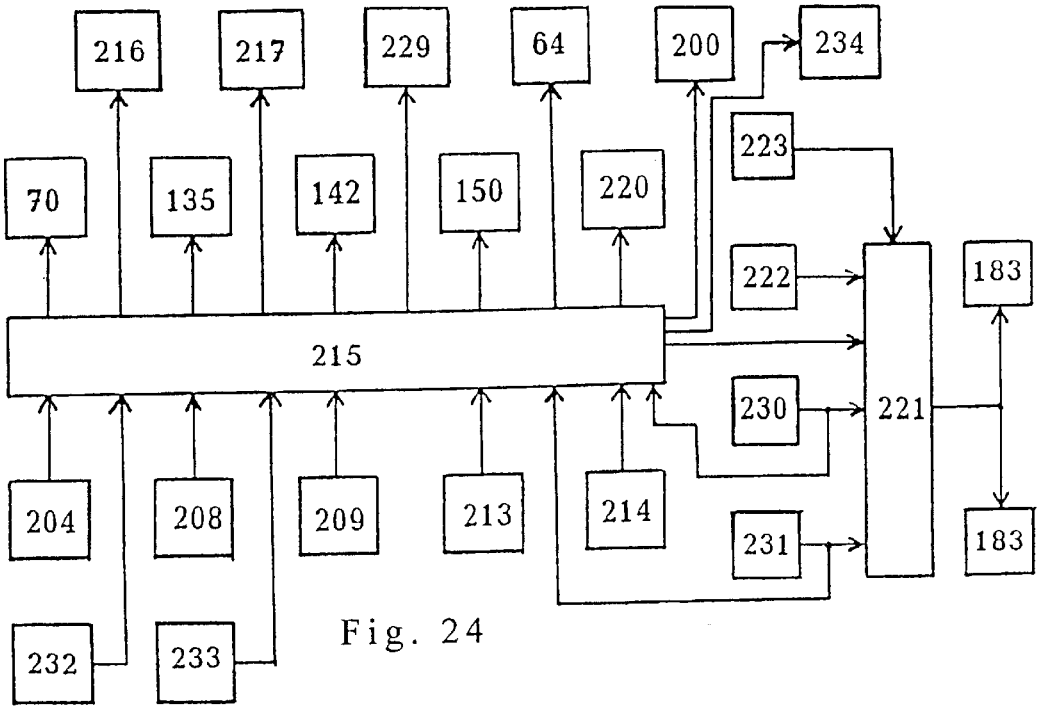
FIG. 24—block-diagram of the device of machine monitoring and control.

Device of monitoring and control of machine 3 is fitted with means 208 for monitoring the angle of transverse inclination of base frame 6 and means 209 of monitoring the angle of rotation of soil feeding organ 13 relative to base frame about axis 17. The means 208 is made in the form of a unified measurement module which is applied in systems of stabilisation and control of the position of working organs of road construction machinery and is used for measurement of the angle relative to gravity vertical. Module 208 is fastened on frame of base frame close to filling equipment 9. Means 209 is made in the form of sensor 210 of angle of rotation, which is secured on frame 19 of soil feeding organ 13 and is connected by lever 211 and hinged tie rod 212 to lifting frame 12 (FIG. 23).

Figure 21:
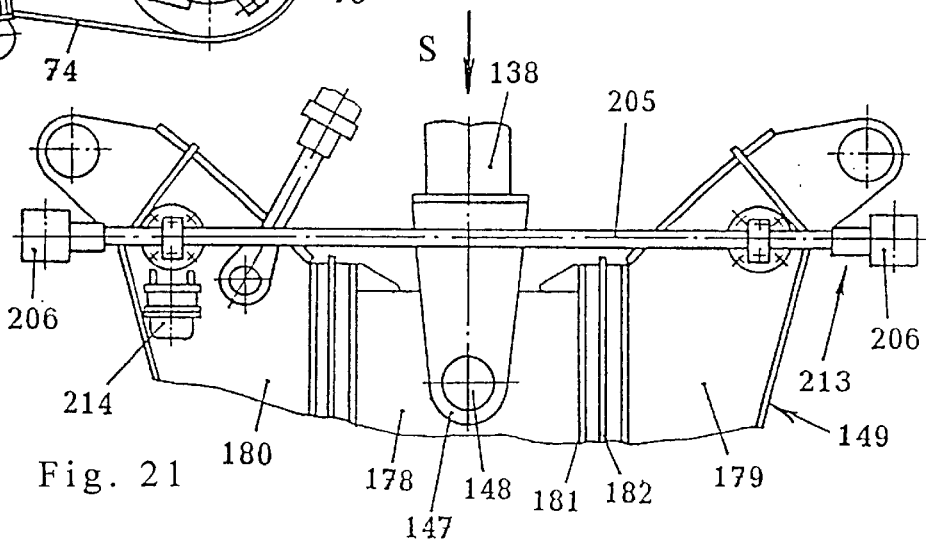
FIG. 21—mounting a contactless sensor of the duct position and sensor of gravity vertical position on the base of soil compacting mechanism.
Figure 22:
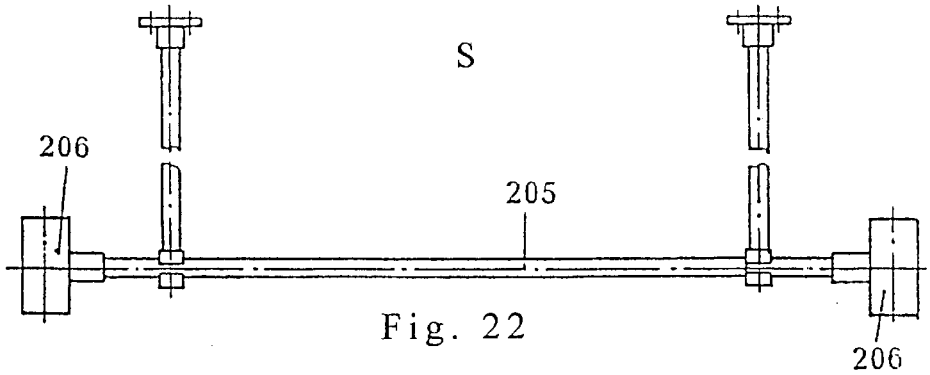
FIG. 22—view S in FIGS. 20 and 21.

Device for monitoring and control of machine 3 has means 213 for monitoring the position of soil compacting mechanism 103 relative to duct 1 in the vertical and horizontal transverse directions. Means 213 can be made in the form of a mechanical tracking system; proceeding from similar considerations, however, as pointed out above for means 204, in the preferable embodiment means 213 is made similar to means 204 in the form of block of receiving aerials 213 (FIG. 21) which is mounted on base 149 with cases 206 arranged symmetrical to a vertical plane of symmetry common with the soil compacting organs 104, 105.

In addition, device for monitoring and control of machine 3 has means 214 for control of transverse gradient of soil compacting mechanism 103, which is made similar to means 208 in the form of a unified measurement module for measurement of the angle relative to gravity vertical, which is mounted on base 149.

Device for monitoring and control of machine 3 has block 215 of information processing and generation of control signals, whose data inputs are connected to the means 204, 208, 209, 213, 214, whereas data outputs to means of indication of panels 216, 217 of control are mounted, respectively, in cabin 218 of vehicle 6 and on remote control panel which can be located on working platform 219. Outputs of control signals of above block 215, are connected to electric magnets of electric hydraulic distributors which perform control of hydraulic cylinders 70, 135 or 195, 142 or 191, 150 or 198.

Device for monitoring and control of machine 3 can have system 220 for automatic control of base frame 6, whose inputs are connected to outputs of block 215.

Soil compacting mechanism 103 is fitted with electric system 221 for automatic reversal of hydraulic cylinders 183, whose inputs are connected to means 222 for monitoring of, at least, upper extreme position of soil compacting organs 104, 105, means 223 for monitoring the highest specified pressure in the piston cavities of hydraulic cylinders 183, and, at least, one control signal output of block 215. Means 222, 223 can be made in the form of a limit switch and pressure relay, respectively. Outputs of the above-mentioned system 221 are connected to electric magnets of electric hydraulic distributors of hydraulic cylinders 183.

In a particular embodiment of machine 3 filling equipment 9 can have means 224 for soil unloading from transport organ 14, which forms third outlet of soil. The third outlet of soil from filling equipment 9 is located with a shift towards base frame 6 relative to first two soil outlets (lower edges of trays 78 of divider 15). In this case, distance $L_{b5}$ between vertical plane of symmetry of first two outlets of soil, to which axis 73 of duct 1 belongs, and the third soil outlet, is greater than half the width $L_{b6}$ of trench 4, and distance $L_{b7}$ between third outlet of soil and longitudinal axis 11 of base frame 6 is greater than half the width $L_{b2}$ of travelling unit 7.

The means 224 can be made in the form of a working organ 225 for soil displacement across conveyor 72 located with clearance $h_4$ above belt 74 of conveyor 72. The means 224 can be made in the form of an A-shaped breast (FIGS. 2, 3) or a flat breast mounted at an angle to conveyor 72, or screw conveyor, or chain element (not shown in the drawings).

For adjustment of clearance $h_4$, the breast is secured by means of a hinge 226 on bracket 227 of gantry 228 and is connected to gantry 228 by hydraulic cylinder 229. Gantry 228 is fastened on frame 71 of conveyor 72. It is preferable for electric magnets of electric hydraulic distributors of hydraulic cylinders 229, 64 to be connected to control signal outputs of block 215, and instead of means 222, 223 or in addition to them, to have means 230 for monitoring the current positions of soil compacting organs 104, 105 and means 231 for monitoring the current values of pressure in piston cavities of hydraulic cylinders 183. The means 230, 231 can be made in the form of displacement sensor and pressure sensor, respectively, and can be connected to data inputs of block 215.

It is preferable for control signal outputs of block 215 to be connected to electric magnets of electric hydraulic distributors of hydraulic cylinder 200 of longitudinal feed of working elements 171.

It is preferable for device of monitoring and control of machine 3 to have sensor 232 of path S of base frame 6 or sensor 232 of speed V of base frame 6 and timer 233 for monitoring time T of operating cycle of soil compacting mechanism 103, which are connected to data inputs of block 215 whose control signal outputs are connected to means 234 of adjustment of the flow rate of working fluid of hydraulic cylinders 183.

In implementation of the method of padding ground below a duct using excavated soil the appropriate apparatus made in the form of machine 3 operates as follows.

Figure 10:
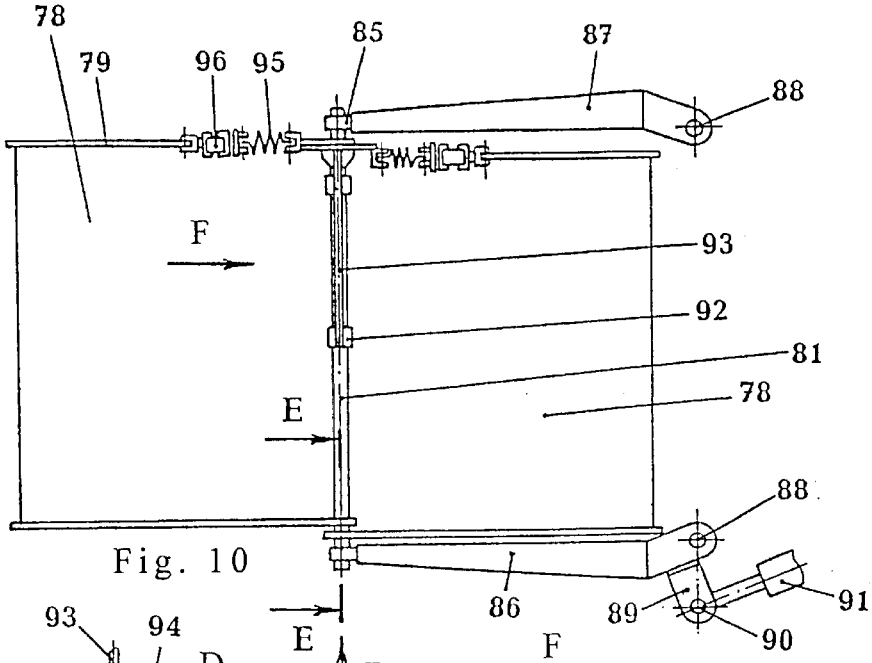
FIG. 10—soil divider, top view.
Figure 11:
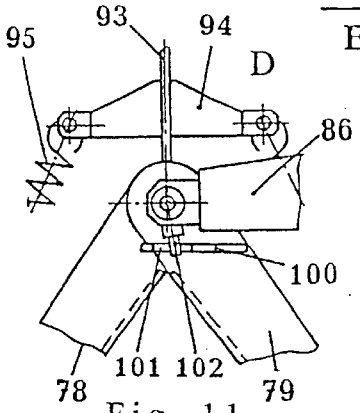
FIG. 11—view F in FIG. 10.

Machine 3 is placed at the end of the system of technical means (not shown in the drawings) for replacement of insulation coating of duct 1, performed at design elevations of duct 1 in trench 4 without interruption of its operation, which in addition to machine 3 includes means for uncovering, digging under, and cleaning of duct 1 and application of new insulation coating on it (not shown in the drawings). In this case by maneuvering base frame 6, machine 3 is positioned so that soil divider 15 and soil compacting mechanism 103 are located above duct 1, whereas soil feeding organ 13 was located at an end face of soil dump 2. In this case, owing to means 204, 213 for monitoring the position of base frame 6 and soil compacting mechanism 103 relative to duct 1 being made in the form of block of receiving aerials and not requiring mechanical contact with the duct in operation, the base frame 6 can be maneuvered in a section of uncovered duct 1 behind excavated soil 2 in the automatic mode by an automatic control system 220 of base frame 6 or in the manual mode by the operator who is guided by readings of indication means of control panel 216. After base frame 6 has been moved into the required position, filling equipment 9 is brought from the transportation position I (FIG. 1) into working position II (FIGS. 1, 2, 3, 5, 6), lowering frame 12 by its rotation about axis 55 of hinges 56 by means of lifting hydraulic cylinders 64; drives 39, 77 of soil feeding 13 and transport 14 organs are switched on and displacement of base frame 6 in the direction from the soil feeding organ 13 to soil dump 2 is begun. The soil feeding chain 18 cutters 29 loosen excavated soil 2 (or unbroken soil), and beams 27 scoop up and transport soil along breast 20. Having passed upper edge of breast 20, the soil under the action of the forces of inertia and gravity, moves along a curvilinear path and is lowered on the moving belt 74 of conveyor belt 72 by means of which soil is transported towards duct 1 and under the action of the forces of inertia and gravity, is discharged onto soil divider 15. Part of soil flow falls on the left (FIGS. 3, 10, 11) tray 78, and part of the flow is stopped by cut-off shield 93 and falls on right tray 78. The left and right soil flows under the impact of the forces of gravity, move along inclined trays 78 and having passed their lower edges are thrown into trench 4. As distance Lb3 between lower edges of trays 78 is greater than diameter D of duct 1, the soil as it falls into trench 4 does not hit duct 1, thus preventing the damage of its insulation coating which may not have a high strength in the first minutes after its application. Cut-off shield 93 oscillates under the impact of the flow of soil and springs 95, thus reducing the amount of soil sticking to it. In order to reduce soil sticking to trays 78 and facilitate soil displacement along them, soil divider 15 can be fitted with vibrators (not shown in the drawings). For many types of soil, however, the oscillatory motions made by trays 78 under the action of unstable, variable, inertia and gravity forces on axle 81 are sufficient. In this case, in the extreme positions of trays 78 edges of slot 101 of plate 100 hitting rest 102 and shaking of trays 78, respectively take place, thus promoting trays cleaning from soil and displacement of the latter along them. In order to achieve the required ratio of the right and left flows of soil, cut-off shield 93 (together with all of divider 15) by means of hydraulic cylinders 91 of regulation, is moved across the flow of soil which is thrown off conveyor 72, thus increasing or reducing the amount of soil which is held up by cut-off shield 93 and fed onto right tray 78. In order to increase volume $Q_1$ of soil which is deposited into trench 4, soil feeding organ 13 is lowered or lifted relative to base frame 6, respectively, turning lifting frame 12 about axis 55 of hinges 56 by means lifting hydraulic cylinders 64. In the embodiment of machine 3 which is fitted with means 224 for unloading soil from transport organ 14, the means 224 is used for accurate adjustment of volume $Q_1$ of soil deposited in the trench. For instance, to reduce volume $Q_1$ of soil deposited in the trench, breast 225 is lowered by means of hydraulic cylinders 229, thus, reducing gap h4, so part of the soil is held up by the breast 225, moved across the conveyor 72 and thrown off it onto the edge of trench 4. In addition, breast 225 uniformly distributes soil across the width of belt 74 of conveyor 72, thus increasing the accuracy and simplifying (or practically eliminating the need for) regulation of soil division by divider 15. Availability of means 224 allows soil feeding organ 13 to be used mainly for grading ground track 16, having largely relieved it of the function of regulation of volume $Q_1$ of soil deposited in the trench. Control of hydraulic cylinders 64, 229 in regulation of the volume of soil can be carried out both in the manual and automatic modes using block 215, as will be described further on.

After placing the soil compacting mechanism 103 over uncovered and padded with soil duct 1, its base 149 is positioned by means of lifting-lowering mechanism 108 at a specified height H above axis 73 of duct 1, by means of transverse displacement mechanism 109 symmetrical (transverse displacement ΔB of base 149 relative to axis 73 of duct 1 in the transverse direction is zero or is within tolerance) to longitudinal axis 73 of duct 1 and horizontally by means of mechanism of rotation 110 (angle α of skewing of base 149 relative to gravitation horizontal or vertical is zero or is within tolerance). The positioning of base 149 of soil compacting mechanism 103 by height, in the horizontal transverse direction and relative to gravity horizontal (vertical) can be performed in the manual mode by the operator, based on visual observation of soil compacting mechanism 103 and readings of the means of indication of appropriate parameters (height H, transverse displacement ΔB and angle α of skewing) of control panel 217, or in the automatic mode by means of block 215. In this case, block 215, having processed the information coming from means 213 for control of the position of soil compacting mechanism 103 relative to duct 1 and means 214 for control of transverse gradient of soil compacting mechanism 103, determines parameters H, ΔB and α, compares them with those assigned, and proceeding from the comparison results, generates at its outputs the signals for control of hydraulic cylinders 135 (195), 142 (191), 150 (198).

After the base 149 of soil compacting mechanism 103 has been positioned as required, the power drive 169 of soil compacting organs 104, 105 is switched on. In this case hydraulic cylinders 183 perform cyclic drawing out and in of the rod, while working elements 171 perform downward cyclic movement from upper position I (FIGS. 14, 19) into lower position II towards each other with simultaneous rotation, decreasing the angle β from $\beta_1$ value to $\beta_2$ value and vice versa from position II into position I. Reversal of hydraulic cylinders 183 is performed by electric system 221 when working elements 171 are placed into the upper I and lower II positions or assigned pressure $P_{max}$ of working fluid is achieved in the piston cavities of hydraulic cylinders 183. When at least one of parameters H, ΔB, α goes beyond the tolerance or in the case of their inadmissible combination, block 215 generates a signal for switching off power drive 169 (of hydraulic cylinders 183), stopping the base frame 6 and giving an audible signal.

Figure 18:
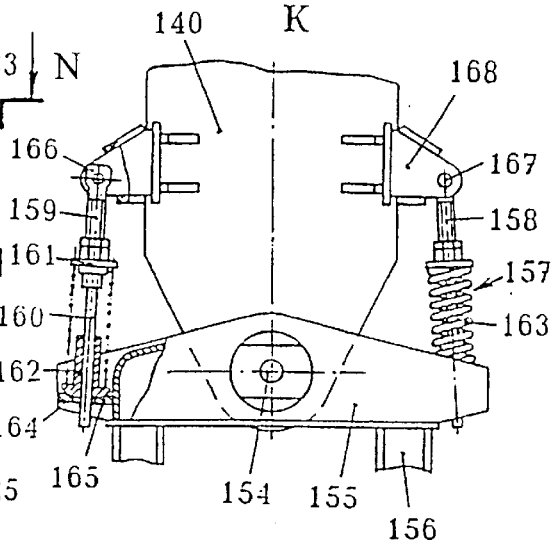
FIG. 18—K view in FIG. 14.
Figure 17:
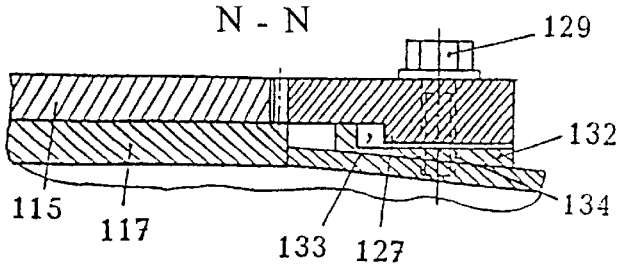
FIG. 17—N—N cut in FIG. 16.

Disconnection mechanism 153 (FIGS. 1, 14, 18) operates as follows. When working elements 171 are lowered as a result of their interaction with the soil being compacted, the movement of elements 171 relative to soil in the direction of displacement of base frame 6 under the action of the force of adhesion of elements 171 to the soil stops, and rotation in hinge 154 through angle y, and displacement of elements 171 relative to base frame 6 in the direction opposite to its displacement direction into the rear position I (FIG. 1) takes place. After completion of soil compacting at the start of lifting of elements 171, when the force of their adhesion to the soil becomes small enough, the hinge 154 rotates in the reverse direction under the action of gravity forces and forces of compression of springs 163 of shock absorbers 157, and elements 171 move relative to the soil and base frame 6 in its displacement direction, i.e. longitudinal feed of elements 171 occurs. In this case, shock absorbers 157 can be adjusted in such a way that in the front position II (FIG. 1), the soil compacting mechanism 103 with arm 138 and shackle 155 will be located in the vertical plane or in such a way that they will deviate forward from the vertical by angle $\gamma_2$ which can be equal to angle $\gamma_1$. In an embodiment of disconnection mechanism 153 (FIG. 19), longitudinal feed of working elements 171 is performed at the required moment by hydraulic cylinder 200. In this case, the soil compacting can be performed without lifting working elements 171 in their lower position II above level 235 of soil deposition in trench 4. However, lifting of elements 171 in their upper position I above level 235 of soil in the trench, and their longitudinal feed in exactly this position, are rational to prevent their moving so along the duct and possible resultant damage of the insulation coating by rather large and sharp stones or other inclusions present in the soil.

Now let us consider the process of soil compacting in more detail. It is possible to achieve sufficient compacting of the soil below duct 1 with sufficiently soft impact of the soil being compacted on the surface of the insulation coating, by plane-parallel displacement of elements 171 along a rectilinear trajectory inclined at a small enough angle to the horizon, for instance 45°. In order to implement it, in soil compacting mechanism 103 it is enough for fourth hinge 177-to be shifted relative to second hinge 174 in the horizontal direction towards connecting rod 170, and for the straight lines passing through the centers of hinges 173, 174, 176, 177, to form a parallelogram. It is, however, impossible to be implemented in narrow trench 4 in view of lack of space. Therefore, for narrow trenches it is rational and sufficient for the spacing of first 173 and third 176 hinges to be greater than the spacing of second 174 and fourth hinges 177 and/or spacing of third 176 and fourth 177 hinges to be greater. than the spacing of first 173 and second 174 hinges. This allows displacement of working elements 171 along a curvilinear trajectory with their simultaneous rotation and fitting into the overall dimensions of narrow trench 4. In the shown in the drawings embodiment of soil compacting mechanism 103, elements 171 in the upper part of the trajectory mainly move in the vertical direction, with an angle $\beta_1$ between their working surfaces 203 large enough to prevent displacement of soil along working surfaces 203 towards duct 1 or damage of its insulation coating by soil. In the lower part of the path, elements 171 move mainly in the horizontal direction, within angle $\beta_2$ between their working surfaces, that on the one hand, should be small enough to provide for soil compacting directly below duct, and on the other hand, a too great reduction of angle $\beta_2$ is not rational because of concurrent increase of angle $\phi$ of slope of the compacted zone of soil and possibility of its breaking up when duct 1 rests against it. Proceeding from these considerations, it is rational for angle $\phi$ to be approximately equal to the angle of the natural sloping of soil, and, therefore, angle $\beta_2=2\times(90°-\phi)$. In the opinion of the authors, the following values of angles $\beta_1$ and $\beta_2$ satisfy the above conditions: $\beta_1 \geqq 90°$; $60° \leqq \beta_2 \leqq 120°$.

In order to ensure soil compacting along the entire height $h_3$ of the space below a duct, which can be of the order of 0.8 m, lifting of elements 171 in their upper position I above level 235 of soil in the trench and location of the greater part of working surface 203 of elements 171 in their lower position II below duct 1, it is necessary for vertical displacement $h_2$ of soil compacting elements to be not less than half of diameter D of duct 1. For soil compacting directly below duct 1 it is rational for horizontal displacement Lb4 of elements 171 to be not less than half of vertical displacement $h_2$.

Model investigations of soil compacting mechanism were performed for compacting loam soil below a duct of diameter D=1220 mm at a height $h_3$=0.84 m with the following values of soil compacting mechanism parameters: $h_2$=0.8 m, $L_{b4}$=0.64 in, $\beta_1$=140°, $\beta_2$=90°. As a result, it was found that the claimed soil compacting mechanism is characterised by insignificant forces on working elements 171 due to coincidence of their movement direction and the required direction of soil deformation. So, applying to each element 171 force R equal to 4 tons, it is possible to achieve bed coefficient Ky equal to 1 MN/m$^3$ with specific pitch of compacting (determined as the ratio of pitch $L_{at}$, of longitudinal feed of elements 171 to their length L, measured along duct axis) t=1.1–1.2. Power consumption in such a compacting mode at the speed of displacement along the duct V=100 m/h is 12 to 15 KW (not taking into account the efficiency factor of the hydraulic drive and soil compacting mechanism 103). Due to the presence of disconnection mechanism displacement of soil compacting mechanism requires the pulling force of not more than 1 to 2 tons.

If in the upper position, elements 171 are completely withdrawn from the soil, the level of filling trench 4 with soil should be not arbitrary, but strictly specified and adjusted so that at the moment when pressure $P_{max}$ is reached in the piston cavities of hydraulic cylinders, at which force $R_{max}$ on elements 171 is equal to the design value, elements 171 did not quite reach extreme lower position II and besides that were in a certain optimal design position relative to the duct. If at the moment of the pressure in hydraulic cylinders 183 rising up to $P_{max}$, elements 171 will be significantly short of lower position II, i.e. they will be located higher than the above design position, the degree of soil compacting below a duct will decrease, here in order to restore the degree of soil compacting, it is necessary to reduce volume $Q_1$ of soil deposited into the trench. If elements 171 come to the extreme lower position II at a pressure lower than $P_{max}$, the degree of soil compacting will also become smaller, in this case volume $Q_1$ of soil deposited in the trench should be increased to restore the degree of soil compacting. In order to provide the appropriate regulation of volume $Q_1$ of soil deposited into the trench, it is preferable for machine 3 to have displacement sensor 230 and pressure sensor 231, the information from which comes to the input of block 215, having processed which (preferably taking into account the information of means 213) block 215 determines the position of working elements 171 at the moment pressure $P_{max}$ is reached and compares it with the required pressure. Proceeding from the results of comparison, block 215 generates at its outputs the signals which can be sent to the appropriate means of indication of panel 216 or to the electric magnets of electric hydraulic distributors of hydraulic cylinders 64, 229 in the automatic control mode.

If the disconnection mechanism 153 incorporates a hydraulic cylinder 200 (FIG. 19) for a forced longitudinal feed of elements 171, and displacement sensor 230 and pressure sensor 231 are available, control of filling 9 and compacting 10 equipment can be performed as follows. In this case filling equipment 9 feeds soil into trench in an excess amount, whereas volume $Q_2$ ($Q_2 \leqq Q_1$) of soil which undergoes compacting, is regulated by increasing or decreasing height $h_2$ of lifting of elements 171 and providing their forced longitudinal feed by hydraulic cylinder 200, when they are lowered into the soil. The soil left above elements 171 is not used during compacting. In this case block 215 having processed the information of sensors 230, 231 (preferably taking into account information of means 213) determines the required (design) upper position of elements 171 and at the moment when elements 171 reach the upper design position, generates at its outputs the signals for stopping hydraulic cylinders 183 and switching on hydraulic cylinder 200 for longitudinal feed of elements 171. Reversal of hydraulic cylinders 200, 183 can be performed independently by electric system 221.

The degree of soil compacting under a duct, characterised by bed coefficient $K_y$, depends on the greatest force $R_{max}$ on elements 171, which is determined by pressure $P_{max}$ in piston cavities of hydraulic cylinders 183, and on specific pitch of compacting t which is determined by path S or speed V of displacement of base frame 6 along duct 1 and duration of time T of operation of soil compacting mechanism, i.e. $t=L_{at}/L_{al}=S/L_{al}=V\times T/L_{al}$. Machine 3 moves in synchronism with other machinery of the system for replacement of insulation coating of a duct, i.e. its speed V can change for reasons independent of it. Therefore, in order to ensure a constant bed coefficient $K_y$ it is rational to envisage in the device for monitoring and control of the machine the capability of regulation of specific pitch of compacting t and/or maximal pressure $P_{max}$ in hydraulic cylinders 183. Thus, it is rational for reversal of hydraulic cylinders 183 to be performed by signals of block 215 which having processed the information of sensor 232 of speed V or path S covered by base frame 6 during time T, which path is equal to pitch $L_{at}$ of longitudinal feed of elements 171, will assign the required ratio of parameters t and $P_{max}$ Here block 215 can allow for angle $\phi_1$ of skewing of base frame 6 relative to gravity vertical, which is entered into it from appropriate device 204 so that in the case of skewing of base frame 6 towards trench 4 pressure $P_{max}$ can be increased with a simultaneous increase of pitch t, and in the case of skewing of base frame 6 in the opposite direction $P_{max}$ can be lowered with a simultaneous reduction of pitch t.

Extremely important is the fact that machine 3 prepares itself the path for displacement of travelling unit 7 of base frame 6 over it. The soil surface can have unevenness (pits, mounds, etc.), riding over which of travelling unit 7 can lead to an abrupt skewing of base frame 6, displacement of soil compacting mechanism 103 from the set position relative to duct 1, which cannot be compensated by mechanisms of lifting-lowering 108, transverse displacement 109 or rotation 110. which may lead to damage of duct 1 or of its insulation coating, and in the best case to stoppage of machine 3, and with it the entire system of machinery for replacement of the insulation coating. In the claimed method of padding ground below a duct such a situation is impossible, as travelling unit 7 of base frame 6 moves over the surface of ground path 16 which is formed by soil feeding organ 13 when feeding excavated soil 2. In this case mounds are cut off by soil feeding organ, and pits remain filled with excavated soil 2. In addition, by means of skewing of soil feeding organ about axis 17, machine 3 is capable of providing the required transverse gradient of path 16, in order to maintain a stable horizontal position of base frame 6 in the transverse plane, and thereby create favourable conditions for operation of compacting equipment 10, also in areas with a considerable transverse gradient. As trench 4 is filled with soil not completely, part of excavated soil 2 remains, and it can be used for forming even and horizontal in the transverse direction path 16, this being especially beneficial in an area with considerable unevenness of the soil or with its considerable transverse gradient. However, as a result of movement of travelling unit 7 over a layer of loose excavated soil 2, skewing of base frame 6 may occur, because of a non-uniform subsidence of soil under the right and left caterpillars of travelling unit 7, this being promoted by cyclic variation of the ratio of bearing pressure in the right and left caterpillars as a result of operation of soil compacting mechanism. In this case, by appropriate skewing of the soil compacting organ 13 relative to the base frame 6, path 16 is formed with a transverse gradient which is opposite in direction and equal in value to skewing of base frame 6 as a result of non-uniform subsidence of soil under the right and left caterpillars. Likewise, it is possible to maintain a stable position of base frame 6 in movement of travelling unit 7 over any soil with a low load-carrying capacity, and compensate for the adverse influence of soil compacting mechanism 103. Control of skewing of soil feeding organ 13 can be performed either in the manual mode by the operator by the readings of the means of indication of angle $\phi_1$ of base frame 6 skewing relative to gravity vertical; and angle $\phi_2$ of skewing of soil feeding organ relative to base frame 6, which are located on panel 216, or in the automatic mode by means of block 215 which forms at its outputs the signals of control of hydraulic cylinders 70 of rotation. In this case, angle $\phi_2$ of skewing of soil feeding organ 13 relative to base frame 6 is initially set to be opposite in direction and equal in value to angle of skewing of base frame 6. If after a certain lapse of time angle $\phi_1$ does not start decreasing, angle $\phi_2$ increased up to the value at which decrease of angle $\phi_1$ is found, and after straightening of base frame 6 (at $\phi_1=0$) angle $\phi_2$ is reduced to the previous value at which a stable position of base frame 6 was preserved.

For optimal operation of compacting equipment 10, it should be located strictly in the transverse plane (normal to the direction of displacement of base frame 6). The position of compacting equipment 10 is regulated by adjustment of the position of bracket 114 relative to gantry 118. In this case, nuts 120 and bolts 129 are loosened, toothed quadrant 126 of plate 125 is brought out of engagement with toothed quadrant 131 of base plate 115 of bracket 114, and bracket 114 is rotated about axis 123 of pin 116 through the required angle, in keeping with scale 130. After that, toothed quadrant 126 is bought into engagement with toothed quadrant 131 and bolts 129 and nuts 120 are tightened.

What is claimed is:

1. A method of padding the ground below a duct using excavated soil using a transport organ, a soil feeding organ, and soil compacting organs on one or two vehicles, comprising:

picking-up the excavated soil;

transporting the excavated soil with the transport organ in a direction from an excavated soil dump to a trench with the duct;

depositing the excavated soil in the trench from both sides of the duct to fill at least the space below the duct with the excavated soil; and compacting the deposited soil in at least the space below the duct with soil compacting organs in a cyclic manner during continuous displacement along the duct of the one or two vehicles carrying the soil feeding, transport and soil compacting organs, the step of compacting the deposited soil comprising:

during compacting cycles, soil compacting organs applying a force on the previously deposited soil during continuous displacement along the duct of the one or two vehicles carrying the soil feeding, transport and soil compacting organs by moving working elements of the soil compacting organs in a downward direction and towards each other, wherein the working elements are stationary in the displacement direction with respect to the soil during the compacting cycles; and between compacting cycles, moving the working elements of the soil compacting organs relative to the soil in the displacement direction of the one or two vehicles.

2. The method according to claim 1, comprising:

controlling a volume of soil deposited in the trench by discharging a volume of soil from the transport organ on a ground strip located between a travelling unit of the one or two vehicles and the trench.

3. The method according to claim 1, wherein the working elements are rotated in a plane normal to the displacement direction of the one or two vehicles such that an angle (β) which they define becomes smaller.

4. The method according to claim 1, wherein during movement of the working elements in the displacement direction of the one or two vehicles the working elements are at least partially withdrawn from the soil.

5. The method according to claim 4, comprising: determining an actual position of the working elements with a design force on the working elements, comparing the actual position of the working elements with an appropriate design position of the working elements, and proceeding from the comparison results, preserving, increasing, or lowering the level of filling the trench with soil.

6. The method according to claim 1, wherein the excavated soil is deposited in the trench up to a level which is higher than a level required for padding the ground below the duct, while displacement of the working elements in the displacement direction of the one or two vehicles is performed with the working elements lowered into the soil.

7. The method according to claim 6, wherein an actual position of the working elements is determined with a design force on the working elements, the actual position is compared with their appropriate design position, and proceeding from comparison results, the level of lifting of the working elements is preserved, or increased or lowered.

8. The method according to claim 1, wherein soil compacting is performed with a constant maximal force on the working elements and at a specific compacting pitch.

9. The method according to claim 1, wherein the specific compacting pitch is increased when increasing a maximal force on the working elements, and vice versa.

10. The method according to claim 9, wherein the maximal force on the working elements is increased in the case of skewing of the vehicle carrying equipment for compacting soil below the duct in the direction of the trench and vice versa.

11. The method according to claim 1, further comprising automatically positioning the working elements of the soil compacting organs relative to the duct.

12. The method according to claim 1, wherein one of the one or two vehicles carries the soil feeding organ, soil transport organ, and soil compacting organs, the one vehicle having a base frame to which the soil feeding organ, the soil transport organ, and the soil compacting organs are hung, the method further comprising:

forming a ground path using a part of the excavated soil; and grading the ground path in the transverse direction by skewing the soil feeding organ relative to the base frame in a plane which is normal to the displacement direction of the one vehicle by rotating the soil feeding organ about a longitudinal axis of rotation, and moving the one vehicle over the ground path.

13. The method according to claim 12, wherein the step of grading the ground path includes grading the ground path to have a transverse gradient equal in value and opposite in direction to an angle of skewing of the one vehicle resulting from non-uniform subsidence of soil under a travelling unit of the vehicle.

14. A device for padding the ground below a duct using excavated soil comprising:

at least one vehicle with a travelling unit for displacement over the ground surface, which carries equipment for filling a trench with the duct with excavated soil, the equipment for filling a trench including a soil feeding organ, a transport organ and a device for lifting-lowering the soil feeding organ relative to the vehicle; and equipment for compacting the soil below the duct including a soil compacting mechanism with soil compacting organs and a device for hanging the soil compacting mechanism to the vehicle with the capability of forced displacement and rigid fastening relative to the vehicle in a plane normal to the displacement direction of the vehicle, wherein the soil feeding organ is located at an end face of the travelling unit and is wider than the vehicle, the device for hanging the soil compacting mechanism is fitted with a disconnection mechanism for cyclic displacement of the soil compacting organs relative to the vehicle in the displacement direction of the vehicle, the soil compacting organs being a rammer-type and located behind the zone of soil discharging from the transport organ in the displacement direction of the vehicle.

15. The device according to claim 14, wherein the equipment for filling the trench with the duct with excavated soil is fitted with a device for forced rotation of the soil feeding organ relative to the vehicle in a plane which is normal to the direction of displacement of the vehicle.

16. The device according to claim 14, wherein the equipment for filling the trench with the duct with excavated soil is made with at least two outlets for soil, the distance between the two outlets in the horizontal direction normal to the displacement direction of the vehicle is larger than a diameter of the duct.

17. The device according to claim 14, wherein the device for hanging the soil compacting mechanism to the vehicle includes interconnected mechanisms for forced lifting-lowering, transverse displacement and rotation of the soil compacting mechanism.

18. The device according to claim 14, wherein the soil feeding, transport and soil compacting organs are hung to the base frame of one vehicle.

19. The device as in claim 14, wherein the soil compacting mechanism comprises:

a base which carries the soil compacting organs, wherein each soil compacting organ includes a connecting rod with a working element at a lower end of each connecting rod, a lower lever which is connected to the connecting rod by a first hinge, and to the base by a second hinge, an upper lever which is connected to an upper end of the connecting rod by a third hinge, and to the base by a fourth hinge, and the soil compacting organ being formed such that the fourth hinge is shifted relative to the second hinge towards the connecting rod, the spacing of the first and the third hinges is greater than spacing of the second and fourth hinges, or the spacing of the third hinge and the fourth hinge hinges is greater than the spacing of the first hinge and the second hinge.

20. The device as in claim 14, wherein the working surfaces of the working elements in their upper position are located horizontally or are facing each other with an angle β to each other of not less than 90°.

21. The device as in claim 14, wherein the working surfaces of the working elements in their lower position are located at an angle β to each other, the angle β being in the range of 60° to 120°.

22. The device as in claim 14, wherein the distance along the vertical between the working element of each soil compacting organ in its extreme upper and lower positions is not less than half of a diameter of the duct, and the distance along the horizontal between the working element in its extreme upper and lower positions is not less than half of the distance along the vertical.

23. The device as in claim 14, wherein the base includes a beam and brackets, and at least upper and lower levers of the soil compacting organs mounted on the brackets, the brackets being fastened by means of detachable joints to the beam such that the brackets may be placed in at least two positions along the length of the beam.

24. The device as in claim 14, wherein each soil compacting organ has a power drive which is made in the form of a hydraulic cylinder, the hydraulic cylinder being connected by hinges to an upper lever and to a base.

25. The device as in claim 14, wherein upper levers are made in the form of two-arm and L-shaped levers, and the soil compacting mechanism is fitted with a synchronizing tie rod connected by its ends to the second arms of the upper levers by means of hinges.

26. The device according to claim 14, comprising:

power drives, the power drives controlling the position of the soil compacting mechanism; and a control system including:

a position monitoring device for monitoring the position of the soil compacting mechanism relative to the duct;

a lateral inclination monitoring device for monitoring lateral inclination of the soil compacting mechanism; and a processor, wherein the processor receives information from the position monitoring device and the lateral inclination monitoring device and generates power drive control signals.

27. Equipment for soil compacting below a duct, including:

a soil compacting mechanism including at least two soil compacting organs for compacting soil from both sides of the duct, each soil compacting organ having a working element which compacts soil under the duct; and a device for hanging the soil compacting mechanism to a vehicle including:

an integrated mechanism for forced displacement and rigid fastening of the soil compacting mechanism relative to the vehicle in a plane normal to the displacement direction of the vehicle, wherein the device is fitted with a disconnection mechanism for cyclic displacement of the soil compacting organs relative to the vehicle in the displacement direction of the vehicle, the disconnection mechanism including a kinematic joint which is connected into a sequence of kinematic elements of the integrated mechanism and moves in a plane parallel to the displacement direction of the vehicle.

28. The equipment according to claim 27, wherein the integrated mechanism includes interconnected mechanisms for forced lifting-lowering, transverse displacement, and rotation of the soil compacting mechanism.

29. The equipment according to claim 27, wherein the kinematic joint of the disconnection mechanism is made in the form of a hinge with an axis of rotation located in a plane normal to the displacement direction of the vehicle.

30. The equipment according to claim 29, wherein the axis of rotation is located horizontally.

31. The equipment according to claim 29, wherein the disconnection mechanism is fitted with at least one elastic element connected to rigid elements which are connected to each other by the hinge and form a kinematic pair.

32. The equipment according to claim 27, wherein the disconnection mechanism is fitted with a power drive of longitudinal feed connected to rigid elements which are connected to each other by the hinge and form a kinematic pair.

33. The equipment according to claim 32, wherein the power drive of longitudinal feed is a hydraulic cylinder that moves the working elements in the displacement direction when the working elements are lowered into the soil at a design depth, and wherein the hydraulic cylinder is controlled by an automatic device.

34. The equipment according to claim 27, wherein the integrated mechanism comprises a lifting boom having a root which is connected to a support mounted on the frame of the vehicle by means of a first hinge and power drive of lifting-lowering; and an arm with a first end connected to a head part of the lifting boom by means of a kinematic joint which includes a second hinge and a power drive of transverse displacement, and a second end connected to the soil compacting mechanism by means of a third hinge and a power drive of rotation such that the kinematic pair of the disconnection mechanism includes a boom head part and a shackle which is connected to the first end of the arm by means of the second hinge.

35. The equipment as in claim 27, wherein the soil compacting mechanism comprises:

a base which carries the soil compacting organs, wherein each soil compacting organ includes a connecting rod with a working element at a lower end of each connecting rod, a lower lever which is connected to the connecting rod by a first hinge, and to the base by a second hinge, an upper lever which is connected to an upper end of the connecting rod by a third hinge, and to the base by a fourth hinge, and the soil compacting organ being formed such that the fourth hinge is shifted relative to the second hinge towards the connecting rod, or the spacing of the first and the third hinges is greater than spacing of the second and fourth hinges, or the spacing of the third hinge and the fourth hinge hinges is greater than the spacing of the first hinge and the second hinge.

36. The equipment as in claim 27, wherein the working surfaces of the working elements in their upper position are located horizontally or are facing each other with an angle $\beta$ to each other of not less than 90°.

37. The equipment as in claim 27, wherein the working surfaces of the working elements in their lower position are located at an angle $\beta$ to each other, the angle $\beta$ being in the range of 60° to 120°.

38. The equipment as in claim 27, wherein the distance along the vertical between the working element of each soil compacting organ in its extreme upper and lower positions is not less than half of a diameter of the duct, and the distance along the horizontal between the working element in its extreme upper and lower positions is not less than half of the distance along the vertical.

39. The equipment as in claim 29, wherein the base includes a beam and brackets, and at least upper and lower levers of the soil compacting organs mounted on the brackets, the brackets being fastened by means of detachable joints to the beam such that the brackets may be placed in at least two positions along the length of the beam.

40. The equipment as in claim 27, wherein each soil compacting organ has a power drive which is made in the form of a hydraulic cylinder, the hydraulic cylinder being connected by hinges to an upper lever and to a base.

41. The equipment as in claim 27, wherein upper levers are made in the form of two-arm and L-shaped levers, and the soil compacting mechanism is fitted with a synchronizing tie rod connected by its ends to the second arms of the upper levers by means of hinges.

42. A device for padding the ground below a duct using excavated soil comprising:

at least one vehicle with travelling unit for displacing the vehicle over the ground surface, the vehicle carries:

equipment for filling a trench with the duct with excavated soil, the equipment for filling the trench including a soil feeding organ, a transport organ and a device for lifting and lowering the soil feeding organ relative to the vehicle, wherein the soil feeding organ is located at an end face of the travelling unit and is wider than the travelling unit, and equipment for compacting the soil below the duct including a soil compacting mechanism with soil compacting organs and a device for hanging the soil compacting mechanism to the vehicle with the capability of forced displacement and rigid fastening relative to the vehicle in a plane normal to the displacement direction of the vehicle, the device for hanging the soil compacting mechanism is fitted with a disconnection mechanism for cyclic displacement of the soil compacting organs relative to the vehicle in its displacement direction, the soil compacting organs being a rammer-type and being located behind the zone of soil discharging from the transport organ in the displacement direction of the vehicle, the soil compacting mechanism including a base which carries the soil compacting organs, each soil compacting organ including a connecting rod with a working element at a lower end of each connecting rod, a lower lever which is connected to the connecting rod by a first hinge, and to the base by a second hinge, and an upper lever which is connected to an upper end of the connecting rod by a third hinge, and to the base by a fourth hinge, the soil compacting organ being formed such that the fourth hinge is shifted relative to the second hinge towards the connecting rod, the spacing of the first and the third hinges is greater than spacing of the second and fourth hinges, or the spacing of the third hinge and the fourth hinge hinges is greater than the spacing of the first hinge and the second hinge.

43. The device according to claim 42, wherein the working surfaces of the working elements in their upper position are located horizontally or are facing each other with an angle (β) to each other of not less than 90°.

44. The device according to claim 42, wherein the working surfaces of the working elements in their lower position are located at an angle (β) to each other, the angle (β) being in the range of 60° to 120°.

45. The device according to claim 42, wherein the distance along the vertical between the working element of each soil compacting organ in its extreme upper and lower positions is not less than half of the diameter of the duct, and the distance along the horizontal between the working element in its extreme upper and lower positions is not less than half of the distance along the vertical.

46. The device according to claim 42, wherein the base includes a beam and brackets on which at least upper and lower levers of the soil compacting organs are mounted, the brackets being fastened by means of detachable joints to the beam such that the brackets may be placed in at least two positions along the length of the beam.

47. The device according to claim 42, wherein each soil compacting organ has a power drive which is made in the form of a hydraulic cylinder which is connected by hinges to the upper lever and to the base.

48. The device according to claim 42, wherein the upper levers are made in the form of two-arm and L-shaped levers, and the soil compacting mechanism is fitted with a synchronising tie rod connected by its ends to the second arms of the upper levers by means of hinges.

* * * * *